US010615486B2

(12) United States Patent
Svendsen et al.

(10) Patent No.: US 10,615,486 B2
(45) **Date of Patent: *Apr. 7, 2020**

(54) ANTENNA SYSTEM

(71) Applicant: Intel IP Corporation, Santa Clara, CA (US)

(72) Inventors: Simon Svendsen, Aalborg (DK); Ole Jagielski, Viborg (DK)

(73) Assignee: Intel IP Corporation, Santa Clara, CA (US)

( * ) Notice: Subject to any disclaimer, the term of this patent is extended or adjusted under 35 U.S.C. 154(b) by 1 day.

This patent is subject to a terminal disclaimer.

(21) Appl. No.: 15/635,906

(22) Filed: Jun. 28, 2017

(65) Prior Publication Data

US 2019/0006734 A1 Jan. 3, 2019

(51) Int. Cl.

| | |
|---|---|
| ***H01Q 1/22*** | (2006.01) |
| ***H01Q 5/392*** | (2015.01) |
| ***H01Q 5/314*** | (2015.01) |
| ***H01Q 21/28*** | (2006.01) |
| ***H01Q 1/24*** | (2006.01) |
| ***H01Q 9/42*** | (2006.01) |
| ***H01Q 5/40*** | (2015.01) |
| ***H01Q 1/52*** | (2006.01) |

(52) U.S. Cl.

CPC ..... *H01Q 1/2266* (2013.01); *H01Q 1/2283* (2013.01); *H01Q 1/243* (2013.01); *H01Q 1/247* (2013.01); *H01Q 1/521* (2013.01); *H01Q 5/314* (2015.01); *H01Q 5/392* (2015.01); *H01Q 5/40* (2015.01); *H01Q 9/42* (2013.01); *H01Q 21/28* (2013.01)

(58) Field of Classification Search

CPC ..... H01Q 1/2266; H01Q 1/2283; H01Q 1/247

See application file for complete search history.

(56) References Cited

U.S. PATENT DOCUMENTS

| | | | | |
|---|---|---|---|---|
| 6,295,030 | B1 * | 9/2001 | Kozakai | H01Q 1/243 343/700 MS |
| 2005/0057407 | A1 * | 3/2005 | Imaizumi | H01Q 1/242 343/702 |
| 2005/0184914 | A1 * | 8/2005 | Ollikainen | H01Q 1/243 343/702 |
| 2007/0001911 | A1 * | 1/2007 | Fujio | H01Q 9/0407 343/700 MS |
| 2007/0152887 | A1 * | 7/2007 | Castany | H01Q 1/22 343/702 |
| 2007/0268191 | A1 | 11/2007 | Ishizuka et al. | |
| 2007/0285321 | A1 | 12/2007 | Chung et al. | |
| 2008/0018539 | A1 * | 1/2008 | Jung | H01Q 1/243 343/700 MS |

(Continued)

*Primary Examiner* — Daniel Munoz
*Assistant Examiner* — Bamidele A Jegede
(74) *Attorney, Agent, or Firm* — Schiff Hardin LLP

(57) ABSTRACT

Described is an antenna system for wireless communication. The antenna system can include a support plane; a first antenna element coupled to the support plane; and a second antenna element coupled to the support plane and positioned in balance with the first antenna. The support plane can include a slot that is configured to create a balanced relationship between the first and the second antenna elements. The system can include an electrical component connected across a width of the slot and configured to tune a current balance between the first and the second antenna elements.

27 Claims, 13 Drawing Sheets

(56) References Cited

U.S. PATENT DOCUMENTS

2009/0033561 A1 2/2009 Pros et al.
2010/0053022 A1* 3/2010 Mak ..... H01Q 1/2283 343/893
2010/0156741 A1* 6/2010 Vazquez ..... H01Q 1/2291 343/846
2010/0238072 A1* 9/2010 Ayatollahi ..... H01Q 1/243 343/700 MS
2011/0050528 A1* 3/2011 Montgomery ..... H01Q 1/243 343/795
2011/0228713 A1 9/2011 Alexopoulos et al.
2011/0237207 A1 9/2011 Bauder
2011/0298669 A1* 12/2011 Rao ..... H01Q 1/243 343/702
2013/0076580 A1* 3/2013 Zhang ..... H01Q 1/243 343/720
2013/0099980 A1* 4/2013 Hayashi ..... H01Q 1/48 343/700 MS
2013/0120201 A1* 5/2013 Park ..... H01Q 1/48 343/749
2013/0162497 A1 6/2013 Satou et al.
2013/0187817 A1* 7/2013 Jagielski ..... H01Q 1/243 343/751
2013/0257674 A1* 10/2013 Li ..... H01Q 5/321 343/853
2013/0293425 A1* 11/2013 Zhu ..... H01Q 1/243 343/702
2014/0043201 A1* 2/2014 Pelosi ..... H01Q 1/243 343/848
2014/0162572 A1* 6/2014 Hirabayashi ..... H04B 7/04 455/73
2015/0002367 A1* 1/2015 Kosaka ..... H01Q 1/523 343/893
2015/0180123 A1 6/2015 Tatomirescu et al.
2016/0111777 A1* 4/2016 Yang ..... H01Q 1/50 343/841
2016/0248154 A1 8/2016 Tian et al.
2017/0077599 A1* 3/2017 Sayama ..... H01Q 1/523
2017/0187113 A1 6/2017 Svendsen et al.

* cited by examiner

Self-Balanced Dual Shared Isolated Antennas

Slot-Balanced Dual Shared Isolated Antennas

Tuned Dual Shared Isolated Antennas. (LTE antenna tuned to Band 40)

Tuned Dual Shared Isolated Antennas. (LTE antenna tuned to Band 7 or 41)

Tuned Dual Shared Isolated Antennas (without phase balance component)

Tuned Dual Shared Isolated Antennas (with phase balance component)

ANTENNA SYSTEM

BACKGROUND

Field

Aspects described herein generally relate to antenna structures, including dual shared isolated antennas (DSIA).

Related Art

Communications devices can include a plurality of antennas for supporting different communication standards. In order to achieve a good performance, a certain allocated volume is required for each of the antennas. Further, the placing of an antenna within the communications device is an important aspect for the antenna's performance. For example, placing an antenna at the circumference of the communications device may allow for good performance. Moreover, isolation between the antennas is an important aspect (especially for antennas operating at the same frequency). Conventionally, antennas are spaced away from each other in order to provide a sufficient isolation. However, the design of communications devices (e.g. a smartphone, a tablet computer or a laptop) is tending to reduce the bezel around the display of the mobile communications device, and to use full-metal bodies in order to reduce the thickness of the device while maintaining the mechanical strength. That is, the available volume to place one or more antennas within the communications device (especially smaller mobile devices) is limited.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

The exemplary embodiments of the present disclosure will be described with reference to the accompanying drawings. The drawing in which an element first appears is typically indicated by the leftmost digit(s) in the corresponding reference number.

DETAILED DESCRIPTION

Figure 1A:
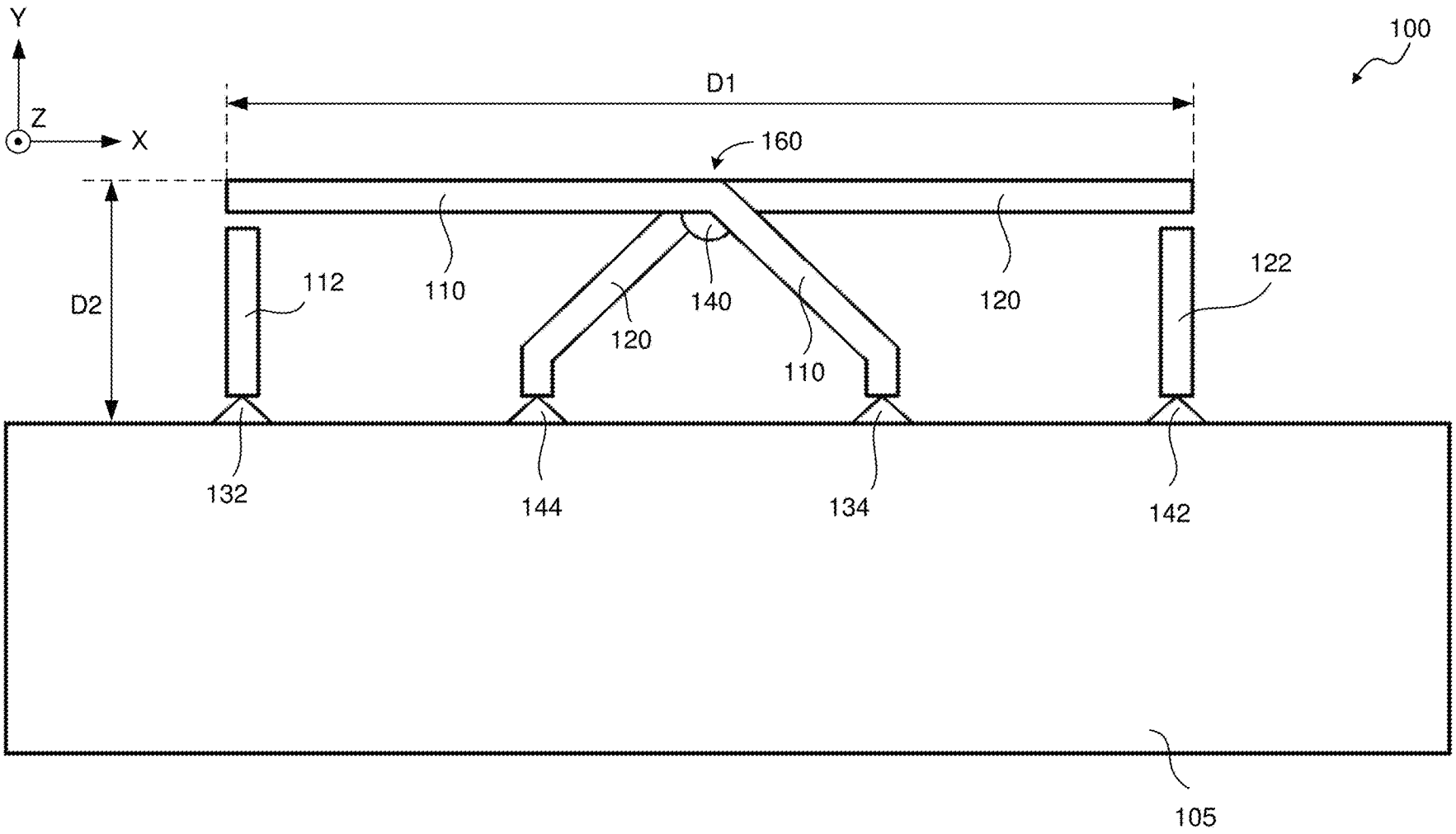
FIG. 1A illustrates a top view of an antenna system according to an exemplary aspect of the present disclosure.

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

FIG. 1 illustrates an antenna system 100 according to an exemplary aspect of the present disclosure. In an exemplary aspect, the antenna system 100 includes an antenna arrangement having a first antenna element 110 and a second antenna element 120. In an exemplary aspect, the antenna elements 110, 120 are radiators. The radiators 110 and 120 can be configured to convert one or more electrical signals into electromagnetic waves, and vice versa.

The first antenna element 110 and the second antenna element 120 are both resonating elements, and are configured to radiate an electromagnetic wave to the environment based on a transmit signal fed to the respective antenna element. For example, the first antenna element 110 and the second antenna element 120 may be both configured to resonate at a same first resonance frequency (e.g. 2.4 GHz). In some examples, the first antenna element 110 may be configured to resonate at a first frequency, and the second antenna element 120 may be configured to resonate at a different second resonance frequency. Vice versa, the antenna elements are further configured to receive an electromagnetic wave, which relates to a receive signal, from the environment.

In an exemplary aspect, a discrete circuit component 140 is coupled to the first antenna element 110 and the second antenna element 120. The discrete circuit component 140 can include one or more resistors, one or more capacitors, and/or one or more inductive coils (e.g., inductors). In an exemplary aspect, the discrete circuit component 140 is one or more inductance coils coupled to the first antenna element 110 and the second antenna element 120, but is not limited thereto. In this example, the discrete circuit component 140 can be referred to as inductance coil 140. The inductance coil 140 can be configured to isolate the first antenna element 110 and the second antenna element 120. For example, the inductance coil 140 may provide a high isolation between both antenna elements 110, 120 over a wide frequency range. With the high isolation, the distance between the first antenna element 110 and the second antenna element 120 can be reduced, such as in small form factor devices (e.g., smart watches, Internet-of-things (IoT) devices). In other words, the required combined volume for the first antenna element 110 and the second antenna element 120 may be reduced compared to conventional antenna structures. Especially for the first antenna element 110 and the second antenna element 120 resonating at a same frequency, a distance between both antenna elements may be greatly reduced compared to conventional antenna structures. As a result, the antenna system 100 may, for example, be used in a mobile communications device providing only a limited volume for the antenna elements.

In an exemplary aspect, the first antenna element 110 is arranged on a first surface of a support plane 105, whereas the second antenna element 120 is arranged on a second surface of the support plane 105. The support plane 105 can include a ground plane, and the antenna elements 110, 120 can be coupled to the ground plane via connections 134 and 144. In an exemplary aspect, the support plane 105 is conductive. The support plane 105 may be, for example, a Printed Circuit Board (PCB) or a carrier plastic part. The PCB can be formed of, for example, glass reinforced epoxy laminate (e.g., FR-4) or one or more other materials as would be understood by one of ordinary skill in the relevant arts. In the example illustrated in FIG. 1A, the first antenna element 110 is arranged on the top side of the support plane 105 relative to the drawing. The second antenna element 120 is arranged on the bottom side of the support plane 105 not visible due to the perspective of the drawing.

In an exemplary aspect, the antenna arrangement of the antenna system 100 may include two single WLAN antennas (antenna elements). The two antennas may be mirrored versions of each other, placed on each side of the PCB and share part of the same volume. The isolation between the two antenna elements (for e.g. 2.4 GHz WLAN) can be increased by adding one or more discrete circuit components 140 at the cross point (e.g., overlapping area 160) of the two antenna elements 110, 120. Again, the discrete circuit component 140 can include one or more resistive components (e.g., resistors), and/or one or more reactive components, such as one or more inductors (inductance coils) and/or one or more capacitors. This discrete component can be configured to create a choke between the two antenna elements 110, 120 so that the RF (Radio Frequency) signal fed to the first coupler 112 is isolated from (e.g., does not "see") the capacitive region of the second antenna element 120 to reduce the coupling to the second coupler 122 (second RF feed 142). Although not shown, one or more decoupling elements (e.g., choke parasitics), such as 5.6 GHz decoupling elements, can be included in the system 100 to improve the isolation between the couplers 132, 142 (e.g., used as radiating elements for 5.6 GHz WLAN).

Figure 1B:
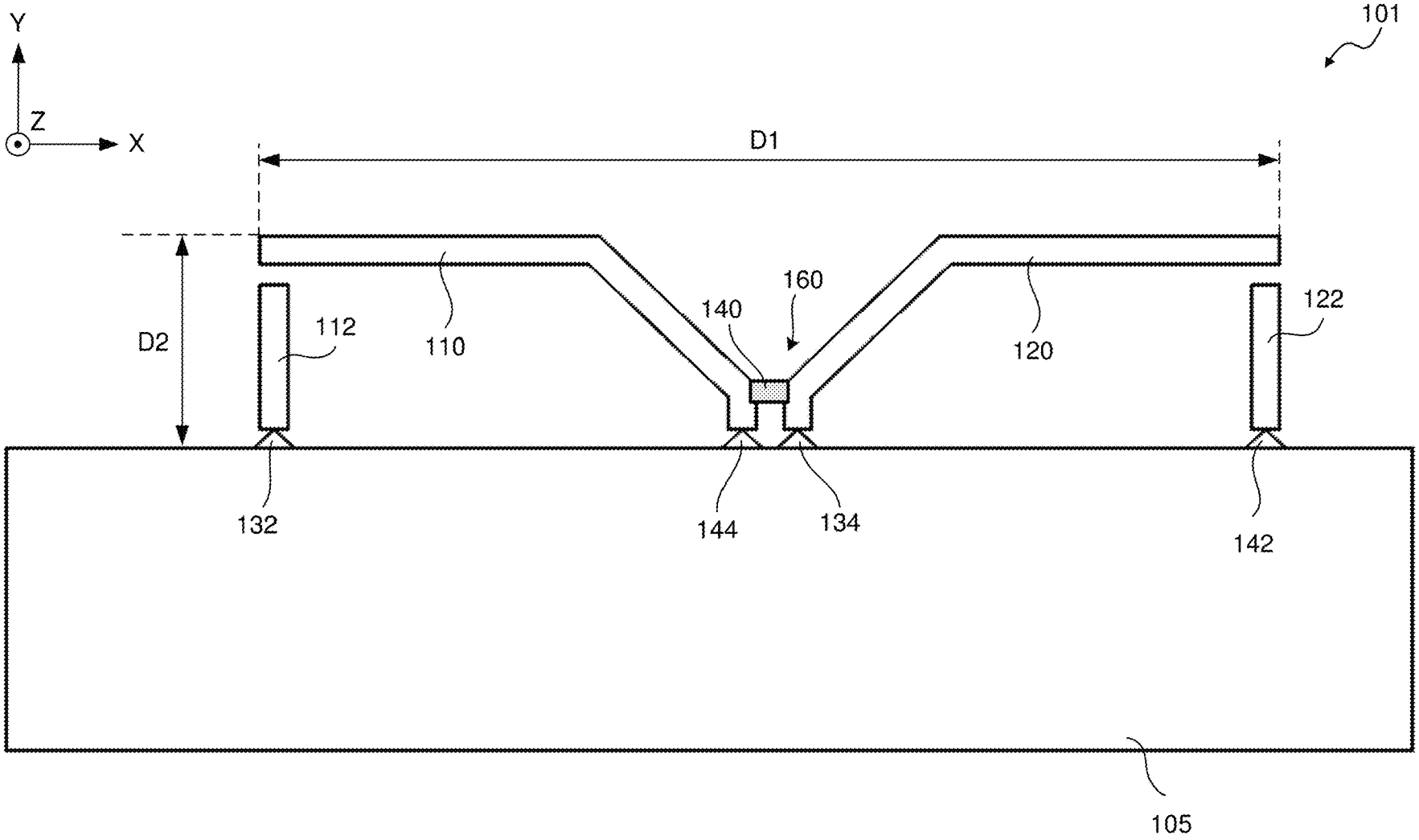
FIG. 1B illustrates a top view of an antenna system according to an exemplary aspect of the present disclosure.

The arrangement of the two antenna elements 110, 120 on opposite surfaces (sides) of the support plane 105 may allow for an area and volume efficient arrangement of the antenna elements. As illustrated in FIG. 1A, an extension of the first antenna element 110 along a first spatial axis x may be at least partly equal to an extension of the second antenna element 120 along the first spatial axis x. In other words, the first antenna element 110 and the second antenna element 120 may at least partly overlap (e.g., overlapping area 160) along the first spatial axis x and when viewed along the third spatial axis z. For example, at least a portion of the first antenna element 110 covers at least a portion of the second antenna element 120 when view along the Z-direction. Further, an extension of the first antenna element 110 along a second spatial axis y (which is orthogonal to the first spatial axis x) may be at least partly equal to an extension of the second antenna element 120 along the second spatial axis y. In other words, the first antenna element 110 and the second antenna element 120 may at least partly overlap along the second spatial axis y. As illustrated in FIG. 1A, the first antenna element 110 and the second antenna element 120 may also completely overlap along the second spatial axis y. The arrangement of the two antenna elements 110, 120 in an overlapping relationship allows for an area and volume efficient arrangement of the antenna elements 110, 120, as well as an antenna system with improved performance. The present disclosure is not limited to the overlapping arrangement of the antenna elements 110, 120, and can include antenna system 101 having non-overlapping antenna elements 110, 120 as illustrated in FIG. 1B. In this aspect, the first antenna element 110 is not overlapping the second antenna element 120 when viewed along the Z-direction. Similar to the antenna system 100, the antenna system 101 can include a discrete circuit component 140 that is coupled to the first antenna element 110 and the second antenna element 120. The discrete circuit component 140 can include one or more resistors, one or more capacitors, and/or one or more inductive coils (e.g., inductors).

The present disclosure is not limited to the arrangement of the antenna elements 110, 120 on opposite sides of the support plane 105. For example, the first antenna element 110 and the second antenna element 120 may be arranged on a same surface of a support plane 105 (e.g. the top side or the bottom side). In aspects where the support plane 105 includes multiple layers (i.e. two or more), the first antenna element 110 may be arranged on a surface of the support plane 105 (e.g. the top side or the bottom side), where the second antenna element 120 may be arranged on one of the intermediate layers of the support plane 105. Alternatively, the first antenna element 110 may be arranged on a first intermediate layer of the support plane 105, where the second antenna element 120 may be arranged on a second intermediate layer of the support plane 105. In this respect, the first intermediate layer and the second intermediate layer of the support plane may be identical or different from each other. In an exemplary aspect, the distance D1 is, for example, 25 mm and the distance D2 is, for example 6 mm, but the antenna system 100 is not limited to these exemplary dimensions.

In an exemplary aspect, the antenna system 100 includes a first electromagnetic coupler 112 and a second electromagnetic coupler 122. The first coupler 112 can be arranged on the first surface of the support plane 105 and the second coupler 122 can be arranged on the second surface of the support plane 105, but is not limited thereto. The first coupler 112 can be galvanically isolated from the first antenna element 110. Similarly, the second coupler 122 can be galvanically isolated from the second antenna element 120. In an exemplary aspect, the antenna elements 110, 120 are respectively connected to a ground plane of support plane 105 via connections 134 and 144.

In an exemplary aspect, the first coupler 112 and the second coupler 122 may be, for example, metal structures. In an exemplary aspect, the first coupler 112 and/or the second coupler 122 are configured as a feeding structure that does not resonate (e.g., when the antenna system operates at a single frequency such as 2.4 GHz). In one or more exemplary aspects, the first coupler 112 and/or the second coupler 122 can also be configured to resonate at a defined resonance frequency (e.g., 5.6 GHz). In an indirect feeding operation, a transmit signal for the first antenna element 110 (e.g. a radio frequency (RF) transmit signal) may be fed (provided) to the first coupler 112 by first feed 132, which is then coupled to the first antenna element 110. For example, due to the capacitive coupling between the first coupler 112 and the first antenna element 110, the transmit signal may be provided to the first antenna element 110 for radiation to the environment. This indirect feeding may allow to match the impedance of the first antenna element 110 to a particular resistance value, for example, 50Ω. Similarly, the second coupler 122 may be used to indirectly feed a transmit signal for the second antenna element 120 to the second antenna element 120 (while the second coupler 122 receives the transmit signal via second feed 142). In this example, for the second antenna element 120, the impedance may be matched to the particular resistance value (e.g. 50Ω). In operation, at least one of the first coupler 112 and the second coupler 122 may directly receive a (radio frequency) transmit signal via their respective feeds 132, 142, and may provide the received transmit signal to the respective antenna element 110, 120. Alternatively, the first coupler 112 and/or the second coupler 122 may indirectly receive a RF transmit signal from their respective feeds 132, 142 via one or more discrete circuit components (e.g., resistors, capacitors, inductors, etc.).

In an alternative aspect, the first antenna element 110 and/or the second antenna element 120 may be configured to directly receive a transmit signal (e.g. RF transmit signal) from the feeds 132, 142. That is, the antenna elements 110 and/or 120 may be directly fed. In this example, the couplers 112, 122 are connected to the respective antenna elements 110, 120 (e.g., there is no gap between the end of the couplers 112, 122 and the elements 110, 120 as shown in FIG. 1A). In an exemplary aspect, the couplers 112, 122 are omitted and the antenna elements 110, 120 are fed from connections 134, 144. However, using the indirect feeding for the antenna elements 110, 120 as illustrated in FIG. 1A may be advantageous in terms of providing a second antenna resonance. For example, the first coupler 112 and/or the second coupler 122 may be configured to resonate at a second resonance frequency (being different from the first resonance frequency of the antenna elements 110, 120). In some examples, the first and the second antenna elements 110, 120 may, e.g., resonate at 2.4 GHz, whereas the first and second coupling elements 112, 122 may resonate at 5.6 GHz. Accordingly, an antenna structure may be provided for a Wireless Local Area Network (WLAN) which supports transmission and reception at 2.4 GHz and 5.6 GHz. In other words, using the couplers as resonators for 5.6 GHz may allow for the inclusion of a second resonance without increasing an overall volume of the antenna arrangement and without reducing the impedance bandwidth of the 2.4 GHz resonance. The present disclosure is not limited to these example resonance frequencies and the antenna elements and/or the couplers can be configured to resonate at other frequencies as would be understood by one of ordinary skill in the art. In an exemplary aspect, the indirect feeding for the antenna elements 110, 120 may advantageously be configured to increase the bandwidth (e.g., at 2.4 GHz) when the system 100 is configured for a single resonance frequency. The indirect feeding is also advantageous in increasing the isolation between the two antenna elements 110, 120.

In an exemplary aspect, the couplers 112 and/or 122 can be configured to connect (e.g., couple) one or more communication devices (e.g. transmitter and/or receiver) to one or more antenna elements. For example, the first coupler 112 can be configured connect a first radio frequency (RF) frontend to the first antenna element 110. Similarly, the second coupler 122 can be configured connect a second RF frontend to the second antenna element 120. In an exemplary aspect, the first and second couplers 112 and 122 can be connected together and to one of the first and second RF frontends. In this example, the connected RF frontend can be coupled to both the first and second elements 110 and 120, where the first antenna element 110 can have a first resonance frequency and the second antenna element 120 can have a second, different resonance frequency. For the purpose of this discussion, a frontend (or RF frontend) can include processor circuitry configured to process one or more incoming and/or outgoing signals. A frontend can include, for example, a digital signal processer (DSP), modulator and/or demodulator, a digital-to-analog converter (DAC) and/or an analog-to-digital converter (ADC), a frequency converter (including mixers, local oscillators, and filters), and/or one or more other components for processing RF, intermediate frequency (IF) and/or other signals as would be understood by those skilled in the relevant arts.

In an exemplary aspect, the one or more of the antenna elements 110, 120 and/or one or more of the electromagnetic couplers 112, 122 can be made of one or more metals, one or more metallic compounds, and/or one or more electrically conductive or semi-conductive materials as would be understood by one of ordinary skill in the relevant arts. The antenna elements 110, 120 and/or the electromagnetic couplers 112, 122 can include one or more active or passive components (e.g., resistors, inductors, capacitors, etc.) and/or processor circuitry. For example, one or more of the couplers 112 and 122 can include one or more circuits having one or more active and/or passive components that are configured to match the impedance of one or more of the antenna elements 110 and 120.

In an exemplary aspect, the first coupler 112 and/or the second coupler 122 can be capacitive couplers. For example, the first coupler 112 can be configured to capacitively couple to the first antenna element 110 and the second coupler 122 can be configured to capacitively couple to the second antenna element 120. The couplers 112 and 122 are not limited to being capacitive couplers and can be configured as inductive couplers that can inductively couple one or more of the antenna elements 110 and 120. For example, the electromagnetic couplers 112 and/or 122 can be inductive couplers that are configured to inductively couple one or more of the antenna elements 110 and 120 to one or more communication devices (e.g., transmitter, receiver, etc.).

In an exemplary aspect, the antenna system 100 can be configured as a transmission antenna system, as a receiving antenna system or as both a transmitting and receiving antenna system. Further, two or more of the antenna systems 100 can be implemented within, or used by, a communication device, where, for example, one antenna system 100 is configured as a transmission antenna system and another antenna system 100 is configured as a receiving antenna system.

In an exemplary aspect, the first and/or second couplers 112, 122 may, in some examples, be arranged on an intermediate layer of the support plane 105. For example, the first coupling element 112 and the second coupler 122 may be arranged on the same intermediate layer of the support plane 105. Alternatively, the first and second couplers 112, 122 may be arranged on different intermediate layers of the support plane 105.

Figure 2A:
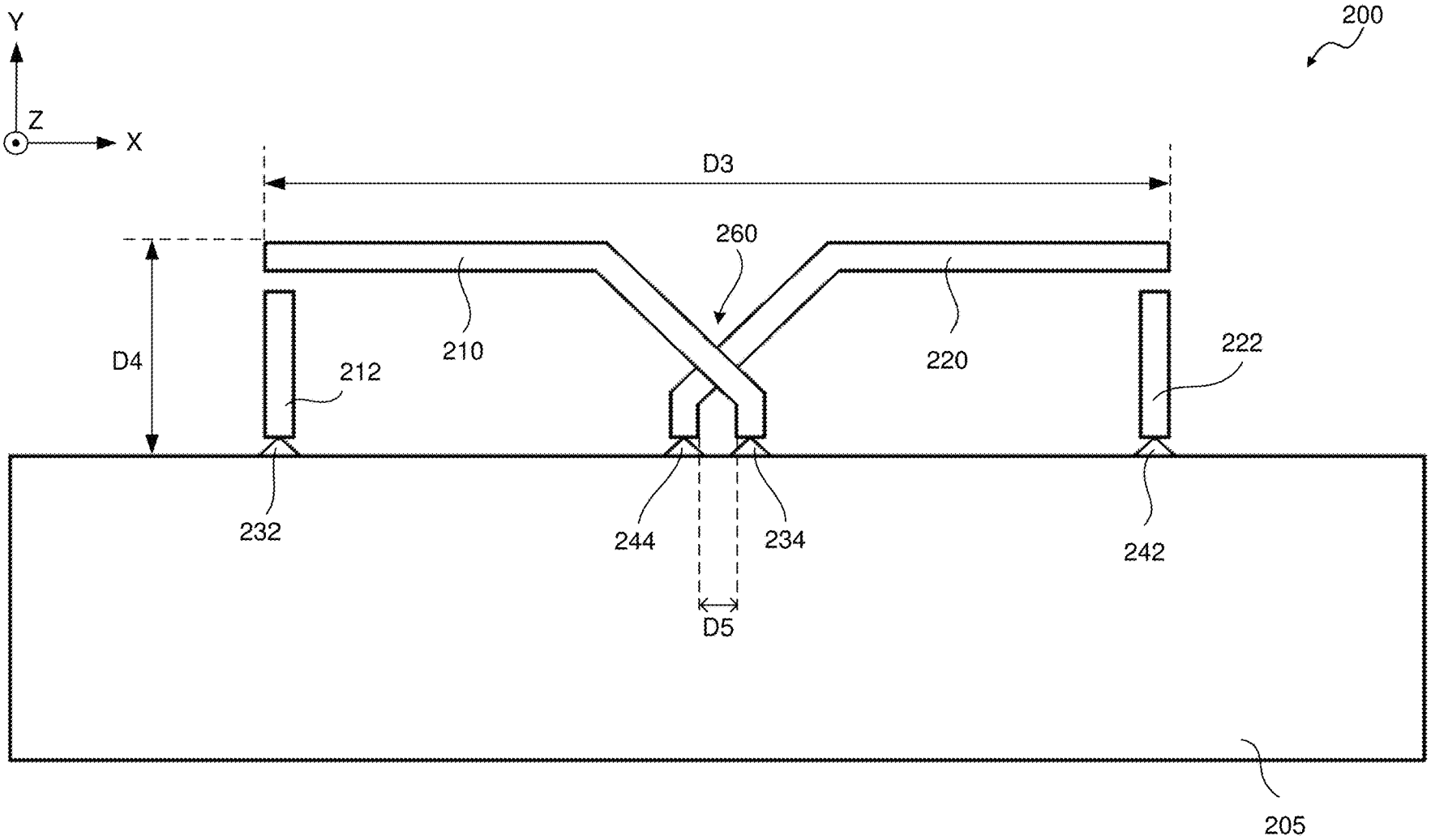
FIG. 2A illustrates a top view of an antenna system according to an exemplary aspect of the present disclosure.

FIG. 2A illustrates an antenna system 200 according to an exemplary aspect of the present disclosure. In an exemplary aspect, the antenna system 200 includes an antenna arrangement having a first antenna element 210 and a second antenna element 220. In an exemplary aspect, the antenna elements 210, 220 are radiators. The radiators 210 and 220 can be configured to convert one or more electrical signals into electromagnetic waves, and vice versa. The antenna system 200 can include first electromagnetic coupler 212 and a second electromagnetic coupler 222. In an exemplary aspect, the couplers 212, and 222 are similar to the couplers 112, 122. In an exemplary aspect, the antenna elements 210, 220 are respectively coupled to a ground plane (e.g., ground potential) of support plane 205 via connections 234 and 244. The antenna elements 210, 220 may be grounded directly or indirectly (e.g. via one or more discrete circuit components, such as one or more resistors and/or one or more reactive components (e.g., inductor, capacitor)). In an exemplary aspect, the antenna element 210, antenna element 220, coupler 212 and coupler 222 are similar to the antenna element 110, antenna element 120, coupler 112 and coupler 122, and discussion of common configurations and properties may have been omitted for brevity.

The first antenna element 210 and the second antenna element 220 are both resonating elements, and are configured to radiate an electromagnetic wave to the environment based on a transmit signal fed to the respective antenna element. For example, the first antenna element 210 and the second antenna element 220 may be both configured to resonate at a same first resonance frequency (e.g. 2.4 GHz). In some examples, the first antenna element 210 may be configured to resonate at a first frequency, and the second antenna element 220 may be configured to resonate at a different second resonance frequency. Vice versa, the antenna elements are further configured to receive an electromagnetic wave, which relates to a receive signal, from the environment.

In an exemplary aspect, the first antenna element 210 is arranged on a first surface of a support plane 205, whereas the second antenna element 220 is arranged on a second surface of the support plane 205. The support plane 205 may be, for example, a PCB or a carrier plastic part. In an exemplary aspect, the support plane 205 is conductive. In the example illustrated in FIG. 2A, the first antenna element 210 is arranged on the top side of the support plane 205 relative to the drawing. The second antenna element 220 is arranged on the bottom side of the support plane 205 not visible due to the perspective of the drawing.

Similar to antenna system 100, the arrangement of the two antenna elements 210, 220 may be on opposite surfaces (sides) of the support plane 205 may allow for an area and volume efficient arrangement of the antenna elements. The present disclosure is not limited to the arrangement of the antenna elements 210, 220 on opposite sides of the support plane 205. For example, the first antenna element 210 and the second antenna element 220 may be arranged on a same surface of a support plane 205 (e.g. the top side or the bottom side). In aspects where the support plane 205 includes multiple layers (i.e. two or more), the first antenna element 210 may be arranged on a surface of the support plane 205 (e.g. the top side or the bottom side), where the second antenna element 220 may be arranged on one of the intermediate layers of the support plane 205. Alternatively, the first antenna element 210 may be arranged on a first intermediate layer of the support plane 205, where the second antenna element 220 may be arranged on a second intermediate layer of the support plane 205. In this respect, the first intermediate layer and the second intermediate layer of the support plane may be identical or different from each other.

In an exemplary aspect, as illustrated in FIG. 2A, an extension of the first antenna element 210 along a first spatial axis x may be at least partly equal to an extension of the second antenna element 220 along the first spatial axis x. In an exemplary aspect, the first antenna element 210 is coupled to a ground plane (e.g., ground potential) of the support plane 205 via connection 234 (e.g. ground connection 234) and the second antenna element is coupled to the ground plane of the support plane 205 via connection 244 (e.g. ground connection 244). In an exemplary aspect, the distance between the ground connections 234 and 244 is reduced compared to the arrangement of the ground connections 134, 144 of antenna system 100. That is, the ground connections 234 and 244 are positioned closer together in the x-axis direction when compared to the connections 134 and 144. For example, the distance D5 is smaller than a corresponding distance between the ground connections 134, 144 of the system 100. In an exemplary aspect, the distance D3 is, for example, 24 mm and the distance D4 is, for example 6 mm, but the antenna system 200 is not limited to these exemplary dimensions. In an exemplary aspect, the ground connections 234 and 244 are positioned immediately adjacent to each other.

In this example, the antenna element 210 overlaps the antenna element 220 at an overlapping location that is closer to the respective ground connections 234, 244 in the y-axis direction. That is, the overlapping location/area 260 is closer to the support plane 205 (ground plane) in comparison to the overlapping location/area 160 of the antenna elements 110, 120 of system 100. In this example, the antenna element 210 at least partially overlaps the antenna element 220 when viewed along the third spatial axis z. For example, at least a portion of the antenna element 210 covers at least a portion of the antenna element 220 when view along the Z-axis direction.

In an exemplary aspect, as illustrated in FIG. 2A, the antenna elements 210, 220 have a first portion that extends parallel or substantially parallel (e.g., horizontal direction relative to the drawing) to the x-axis from their respective coupler 212, 222 towards the opposite coupler 222, 212, a second angled portion that extends at an angle (e.g., 45°) towards the support plane 205, and a third portion that extends parallel or substantially parallel (e.g., vertical direction relative to the drawing) to the y-axis towards the support plane 205 to their respective ground connection 234, 244. In an exemplary aspect, a segment of the second portion of the antenna elements 210 overlaps a segment of the second portion of the antenna elements 220 (e.g. when viewed along the Z-axis direction) to form the overlapping area/location 260.

Figure 2B:
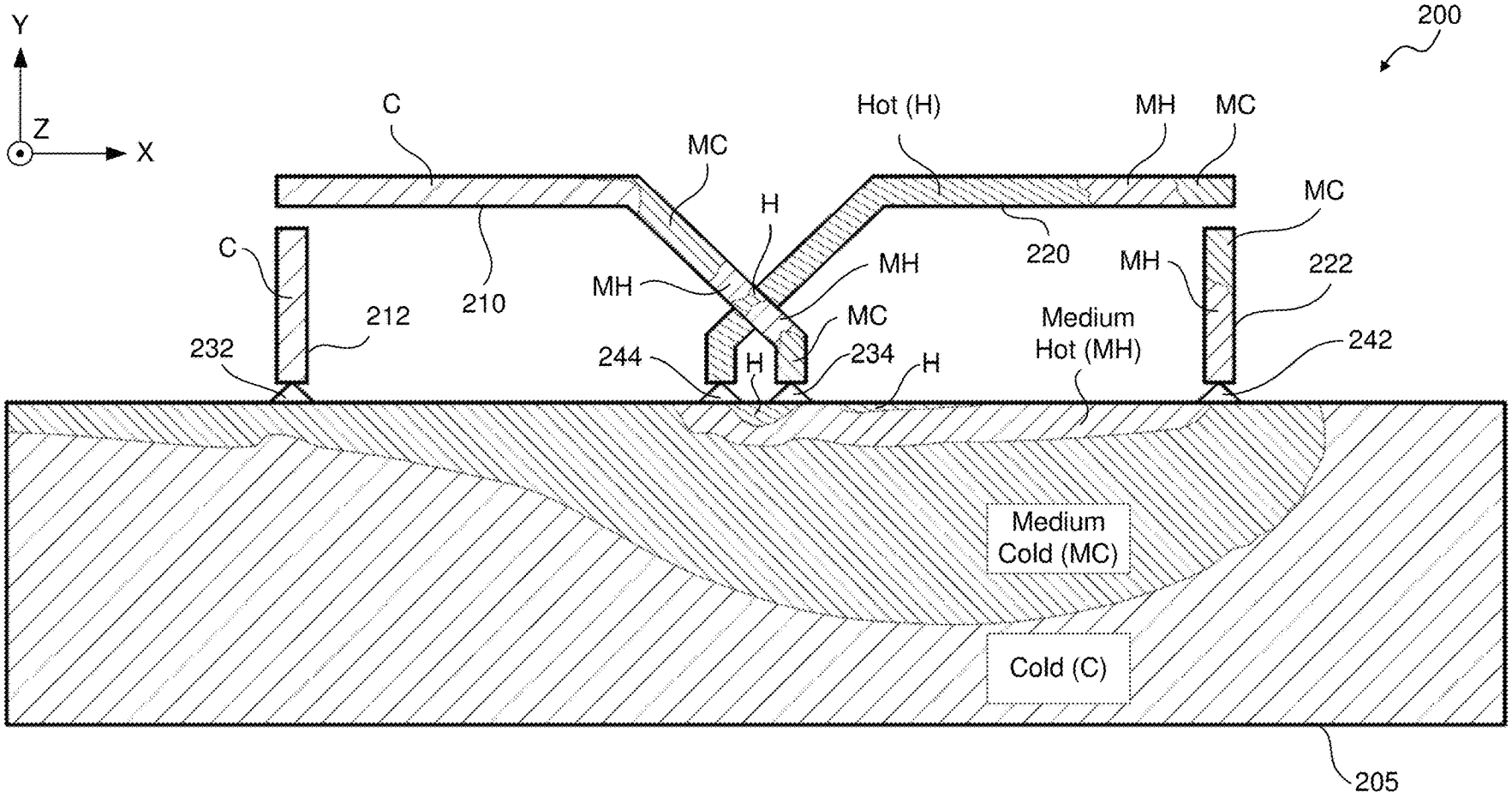
FIG. 2B illustrates a surface current of the antenna system of FIG. 2A.

In an exemplary aspect, the antenna element 210 and the antenna element 220 are positioned in an overlapping configuration (e.g. when viewed along the Z-axis direction) such that the antenna elements 210 and 220 have a current balanced and/or impedance matched relationship. In this example, an increased (e.g., high) impedance point (e.g. virtual high impedance point) is formed at the overlapping segments of the antenna elements 210 and 220. This high impedance point is illustrated in FIG. 2B showing the surface current of the antenna system 200 represented as a thermal image. In the thermal image, lower surface currents are represented by lower temperatures while higher surface currents are represented by higher temperatures. The temperatures from coldest to hottest include cold (C), medium-cold (MC), medium-hot (MH), and hot (H). In this example, the second coupler 222 is feed by an RF signal via feed 242, which couples to the second antenna element 220. The surface current in antenna element 220 increases as represented by the medium-hot and hot temperature areas along the antenna element 220. With the high impedance point (e.g. virtual high impedance point) formed at the overlapping segments of the antenna elements 210 and 220, the coupling from the second antenna element 220 to the first antenna element 210 is reduced. The reduced coupling is illustrated by the lower surface currents in the first antenna element 210, which is represented by the colder temperatures along the antenna element 210.

Figure 5:
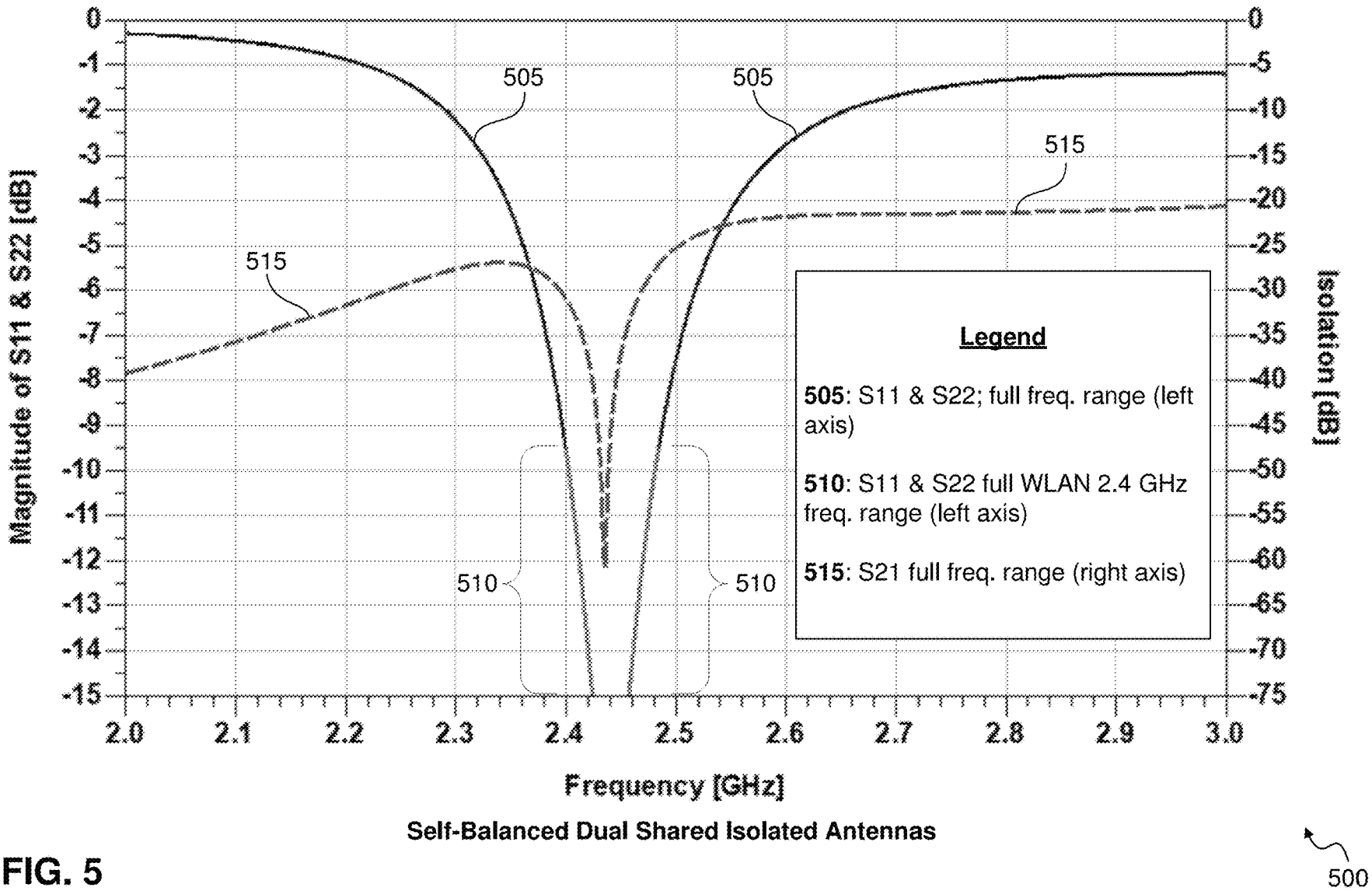
FIG. 5 illustrates an example S-parameter plot for the antenna system of FIG. 2A according to an exemplary aspect of the present disclosure.

The impedance bandwidth and isolation is further illustrated by the plot of the S-parameters in FIG. 5. The S11-parameter represents how much power is reflected from the antenna arrangement, and hence is known as the reflection coefficient. For example, if S11=0 dB (Decibel), then all power is reflected and nothing is delivered to the antenna element. If S11=−10 dB, this implies that 90% of power is delivered to the antenna and 10% of the power is reflected. That is, S11 is the reflected power to be delivered to antenna element 210 by an RF frontend driving the antenna element 210. Similarly S22 is the reflected power to be delivered to antenna element 220 by an RF frontend driving antenna element 220. The S21-parameter represents the power received at the second antenna element 220 relative to the power input to the first antenna element 210 (e.g., the isolation between the antenna elements). For instance, S21=0 dB implies that all the power delivered to the first antenna element 210 ends up at the terminal of the second antenna element 220. If S21=−10 dB, then if 1 Watt (or 0 dB) is delivered to the first antenna element 210, −10 dB (0.1 Watt) of power is received and absorbed at the second antenna element 220.

In an exemplary aspect, the antenna arrangement of the antenna system 200 may include two single WLAN antennas (antenna elements). The two antennas may be mirrored versions of each other, placed on each side of the PCB and share part of the same volume. The isolation between the two antenna elements (for e.g. 2.4 GHz WLAN) can be increased without the addition of one or more discrete circuit components 140, such as one or more resistors and/or one or more reactive components (e.g., inductor, capacitor), as in an aspect of the antenna systems 100 and/or 101 by configuring the antenna elements 210, 220 in a current balanced and/or impedance matched relationship. The balanced/matched relationship creates a choke (e.g. high impedance point) between the two antenna elements 210, 220 so that the RF (Radio Frequency) signal fed to the first coupler 212 does not "see" the capacitive region of the second antenna element 220 to reduce the coupling to the second coupler 222 (second RF feed). This choking characteristic is illustrated in FIG. 2B and the S-parameter plot of FIG. 5, which shows that a sufficient (high) isolation between the antenna elements 110, 120 is realized by the current balanced and/or impedance matched relationship of the antenna system 200.

In an exemplary aspect, the first coupler 212 can be arranged on the first surface of the support plane 205 and the second coupler 222 can be arranged on the second surface of the support plane 205, but is not limited thereto. The first coupler 212 can be galvanically isolated from the first antenna element 210. Similarly, the second coupler 222 can be galvanically isolated from the second antenna element 220.

In an exemplary aspect, the first coupler 212 and the second coupler 222 may be, for example, metal structures. In an exemplary aspect, the first coupler 212 and/or the second coupler 222 are configured as a feeding structure that does not resonate (e.g., when the antenna system operates at a single frequency such as 2.4 GHz). In one or more exemplary aspects, the first coupler 212 and/or the second coupler 222 can also be configured to resonate at a defined resonance frequency (e.g., 5.6 GHz). In an indirect feeding operation, a transmit signal for the first antenna element 210 (e.g. a radio frequency (RF) transmit signal) may be fed (provided) to the first coupler 212 by first feed 232, which is then coupled to the first antenna element 210. For example, due to the capacitive coupling between the first coupler 212 and the first antenna element 210, the transmit signal may be provided to the first antenna element 210 for radiation to the environment. This indirect feeding may allow to match the impedance of the first antenna element 210 to a particular resistance value, for example (but not limited to), 50Ω. Similarly, the second coupler 222 may be used to indirectly feed a transmit signal for the second antenna element 220 to the second antenna element 220 (while the second coupler 222 receives the transmit signal via second feed 242). In this example, for the second antenna element 220, the impedance may be matched to the particular resistance value (e.g. 50Ω). In operation, at least one the first coupler 212 and the second coupler 222 may directly receive a (radio frequency) transmit signal via their respective feeds 232, 242, and may provide the received transmit signal to the respective antenna element 210, 220. Alternatively, the first coupler 212 and/or the second coupler 222 may indirectly receive a RF transmit signal from their respective feeds 232, 242 via one or more discrete circuit components (e.g., resistors, capacitors, inductors, etc.).

In an alternative aspect, the first antenna element 210 and/or the second antenna element 220 may be configured to directly receive a (RF) transmit signal from the feeds 232, 242. That is, the antenna elements 210 and/or 220 may be directly fed. In this example, the couplers 212, 222 are connected to the respective antenna elements 210, 220 (e.g., there is not a gap between the end of the couplers 212, 222 and the elements 210, 220 as shown in FIG. 2A). In an exemplary aspect, the couplers 212, 222 are omitted and the antenna elements 210, 220 are fed from connections 234, 244. However, using the indirect feeding for the antenna elements as illustrated in FIG. 2A may be advantageous in terms of providing a second antenna resonance. For example, the first coupler 212 and/or the second coupler 222 may be configured to resonate at a second resonance frequency (being different from the first resonance frequency of the antenna elements 210, 220). In some examples, the first and the second antenna elements 210, 220 may resonate at, for example (but not limited to), 2.4 GHz, whereas the first and second coupling elements 212, 222 may resonate at, for example (but not limited to), 5.6 GHz. In an exemplary aspect, the antenna structure 200 may be provided for a WLAN that supports transmission and reception at 2.4 GHz and 5.6 GHz. In other words, using the couplers 212, 222 as resonators for 5.6 GHz may allow for the inclusion of a second resonance without increasing an overall volume of the antenna arrangement 200 and without reducing the impedance bandwidth of the 2.4 GHz resonance. The present disclosure is not limited to these example resonance frequencies and the antenna elements 210, 220 and/or the couplers 212, 222 can be configured to resonate at other frequencies as would be understood by one of ordinary skill in the art. In an exemplary aspect, the indirect feeding for the antenna elements 210, 220 may advantageously be configured to increase the bandwidth (e.g., at 2.4 GHz) when the system 200 is configured for a single resonance frequency. The indirect feeding is also advantageous in increasing the isolation between the two antenna elements 210, 220

In an exemplary aspect, the couplers 212 and/or 222 can be configured to connect (e.g., couple) one or more communication devices (e.g. transmitter and/or receiver) to one or more antenna elements. For example, the first coupler 212 can be configured to connect a first RF frontend to the first antenna element 210. Similarly, the second coupler 222 can be configured to connect a second RF frontend to the second antenna element 220. In an exemplary aspect, the first and second couplers 212 and 222 can be connected together and to one of the first and second RF frontends. In this example, the connected RF frontend can be coupled to both the first and second elements 210 and 220, where the first antenna element 210 can have a first resonance frequency and the second antenna element 220 can have a second, different resonance frequency. For the purpose of this discussion, a frontend (or RF frontend) can include processor circuitry configured to process one or more incoming and/or outgoing signals. A frontend can include, for example, a digital signal processer (DSP), modulator and/or demodulator, a digital-to-analog converter (DAC) and/or an analog-to-digital converter (ADC), a frequency converter (including mixers, local oscillators, and filters), and/or one or more other components for processing RF, intermediate frequency (IF) and/or other signals as would be understood by those skilled in the relevant arts.

In an exemplary aspect, the one or more of the antenna elements 210, 220 and/or one or more of the electromagnetic couplers 212, 222 can be made of one or more metals, one or more metallic compounds, and/or one or more electrically conductive or semi-conductive materials as would be understood by one of ordinary skill in the relevant arts. The antenna elements 210, 220 and/or the electromagnetic couplers 212, 222 can include one or more active or passive components (e.g., resistors, inductors, capacitors, etc.) and/or processor circuitry. For example, one or more of the couplers 212 and 222 can include one or more circuits having one or more active and/or passive components that are configured to match the impedance of one or more of the antenna elements 210 and 220.

In an exemplary aspect, the first coupler 212 and/or the second coupler 222 can be capacitive couplers. For example, the first coupler 212 can be configured to capacitively couple to the first antenna element 210 and the second coupler 222 can be configured to capacitively couple to the second antenna element 220. The couplers 212 and 222 are not limited to being capacitive couplers and can be configured as inductive couplers that can inductively couple one or more of the antenna elements 210 and 220. For example, the electromagnetic couplers 212 and/or 222 can be inductive couplers that are configured to inductively couple one or more of the antenna elements 210 and 220 to one or more communication devices (e.g., transmitter, receiver, etc.).

In an exemplary aspect, the antenna system 200 can be configured as a transmission antenna system, as a receiving antenna system or as both a transmitting and receiving antenna system. Further, two or more of the antenna systems 200 can be implemented within, or used by, a communication device, where, for example, one antenna system 200 is configured as a transmission antenna system and another antenna system 200 is configured as a receiving antenna system.

In an exemplary aspect, the first and/or second couplers 212, 222 may, in some examples, be arranged on an intermediate layer of the support plane 205. For example, the first coupling element 212 and the second coupler 222 may be arranged on the same intermediate layer of the support plane 205. Alternatively, the first and second couplers 212, 222 may be arranged on different intermediate layers of the support plane 205.

Figure 3A:
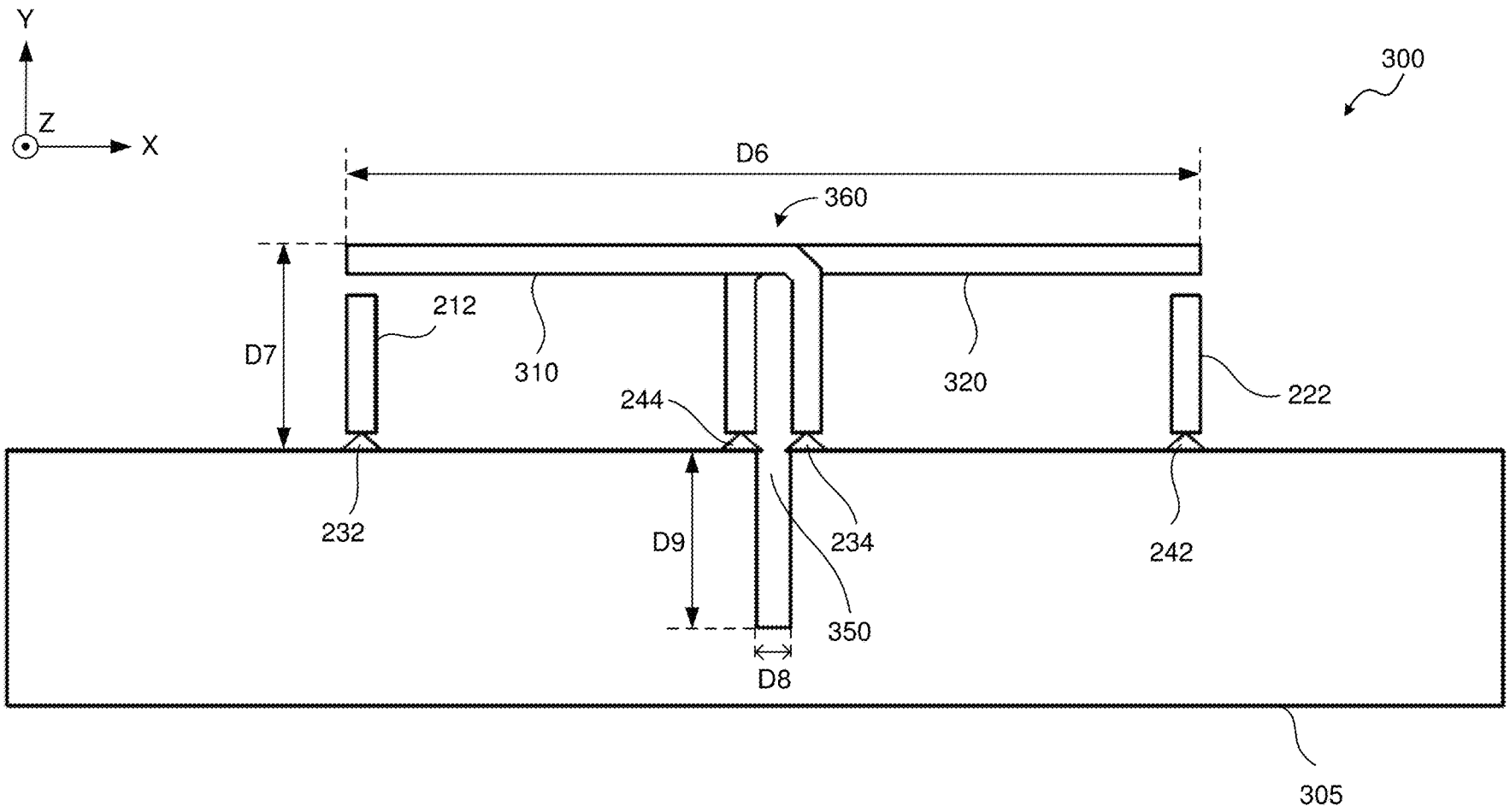
FIG. 3A illustrates a top view of an antenna system having a slot of a support plane according to an exemplary aspect of the present disclosure.

FIG. 3A illustrates an antenna system 300 according to an exemplary aspect of the present disclosure. Antenna system 300 can include one or more components of antenna system 200. Discussion of common elements may have been omitted for brevity.

In an exemplary aspect, the antenna system 300 includes an antenna arrangement having a first antenna element 310 and a second antenna element 320. In an exemplary aspect, the antenna elements 310, 320 are radiators. The radiators 310 and 320 can be configured to convert one or more electrical signals into electromagnetic waves, and vice versa. The first and second antenna elements 310, 320 are fed by RF signal via feeds 232, 242 via first and second couplers 212, 222, respectively. The first coupler 212 and/or the second coupler 222 can be capacitive couplers. The couplers 212 and 222 are not limited to being capacitive couplers and can be configured as inductive couplers that can inductively couple one or more of the antenna elements 210 and 220.

In an exemplary aspect, the antenna elements 310, 320 are respectively coupled to a ground plane (e.g., ground potential) of support plane 305 via connections 234 and 244. The antenna elements 210, 220 may be grounded directly or indirectly (e.g. via one or more discrete circuit components, such as one or more resistors and/or one or more reactive components (e.g., inductor, capacitor)). The first antenna element 310 and the second antenna element 320 are both resonating elements, and are configured to radiate an electromagnetic wave to the environment based on a transmit signal fed to the respective antenna element. For example, the first antenna element 310 and the second antenna element 320 may be both configured to resonate at a same first resonance frequency (e.g. 2.4 GHz). In some examples, the first antenna element 310 may be configured to resonate at a first frequency, and the second antenna element 320 may be configured to resonate at a different second resonance frequency. Vice versa, the antenna elements are further configured to receive an electromagnetic wave, which relates to a receive signal, from the environment.

In an exemplary aspect, the first antenna element 310 is arranged on a first surface of the support plane 305, whereas the second antenna element 320 is arranged on a second surface of the support plane 305. The support plane 305 may be, for example, a PCB or a carrier plastic part similar to support plane 105/205. As illustrated in FIG. 3A, the first antenna element 310 is arranged on the top side of the support plane 305 relative to the drawing. The second antenna element 320 is arranged on the bottom side of the support plane 305 not visible due to the perspective of the drawing.

The arrangement of the two antenna elements 310, 320 on opposite surfaces (sides) of the support plane 305 allows for an area and volume efficient arrangement of the antenna elements 310, 320. The present disclosure is not limited to the arrangement of the antenna elements 310, 320 on opposite sides of the support plane 305. For example, the first antenna element 310 and the second antenna element 320 may be arranged on a same surface of a support plane 305 (e.g. the top side or the bottom side). In aspects where the support plane 305 includes multiple layers (i.e. two or more), the first antenna element 310 may be arranged on a surface of the support plane 305 (e.g. the top side or the bottom side), where the second antenna element 320 may be arranged on one of the intermediate layers of the support plane 305. Alternatively, the first antenna element 310 may be arranged on a first intermediate layer of the support plane 305, where the second antenna element 320 may be arranged on a second intermediate layer of the support plane 305. In this respect, the first intermediate layer and the second intermediate layer of the support plane may be identical or different from each other.

In an exemplary aspect, an extension of the first antenna element 310 along a first spatial axis x may be at least partly equal to an extension of the second antenna element 320 along the first spatial axis x. In an exemplary aspect, the first antenna element 310 is coupled to a ground plane (e.g., ground potential) of the support plane 305 via connection 234 (e.g. ground connection 234) and the second antenna element is coupled to the ground plane of the support plane 305 via connection 244 (e.g. ground connection 244). In an exemplary aspect, the ground connections 234 and 244 are arranged on opposite sides of a slot 350 formed in the support plane 305, which is described in more detail below. In an exemplary aspect, the ground connections 234 and 244 are positioned immediately adjacent to the slot 350.

In an exemplary aspect, the distance D6 is, for example, 24 mm and the distance D7 is, for example 6 mm, but the antenna system 300 is not limited to these exemplary dimensions. In this example, the antenna element 310 overlaps the antenna element 320 at an overlapping location 360 (e.g., when viewed along the Z-axis direction).

In an exemplary aspect, as illustrated in FIG. 3A, the antenna elements 310, 320 have a first portion that extends parallel or substantially parallel (e.g., vertical direction relative to the drawing) to the y-axis away from the support plane 305 from their respective ground connection 234, 244, a second angled portion that extends at an angle (e.g., 45°) with respect to the x-axis, and a third portion that extends parallel or substantially parallel (e.g., horizontal direction relative to the drawing) to the x-axis towards their respective coupler 212, 222.

In an exemplary aspect, one or more portions of the antenna element 310 overlaps one or more portions of the antenna element 320 to form the overlapping area/location 360. For example, as illustrated in FIG. 3A, the second and third portions of antenna element 310 overlaps the third and the second portions of the antenna element 320, respectively.

Figure 3B:
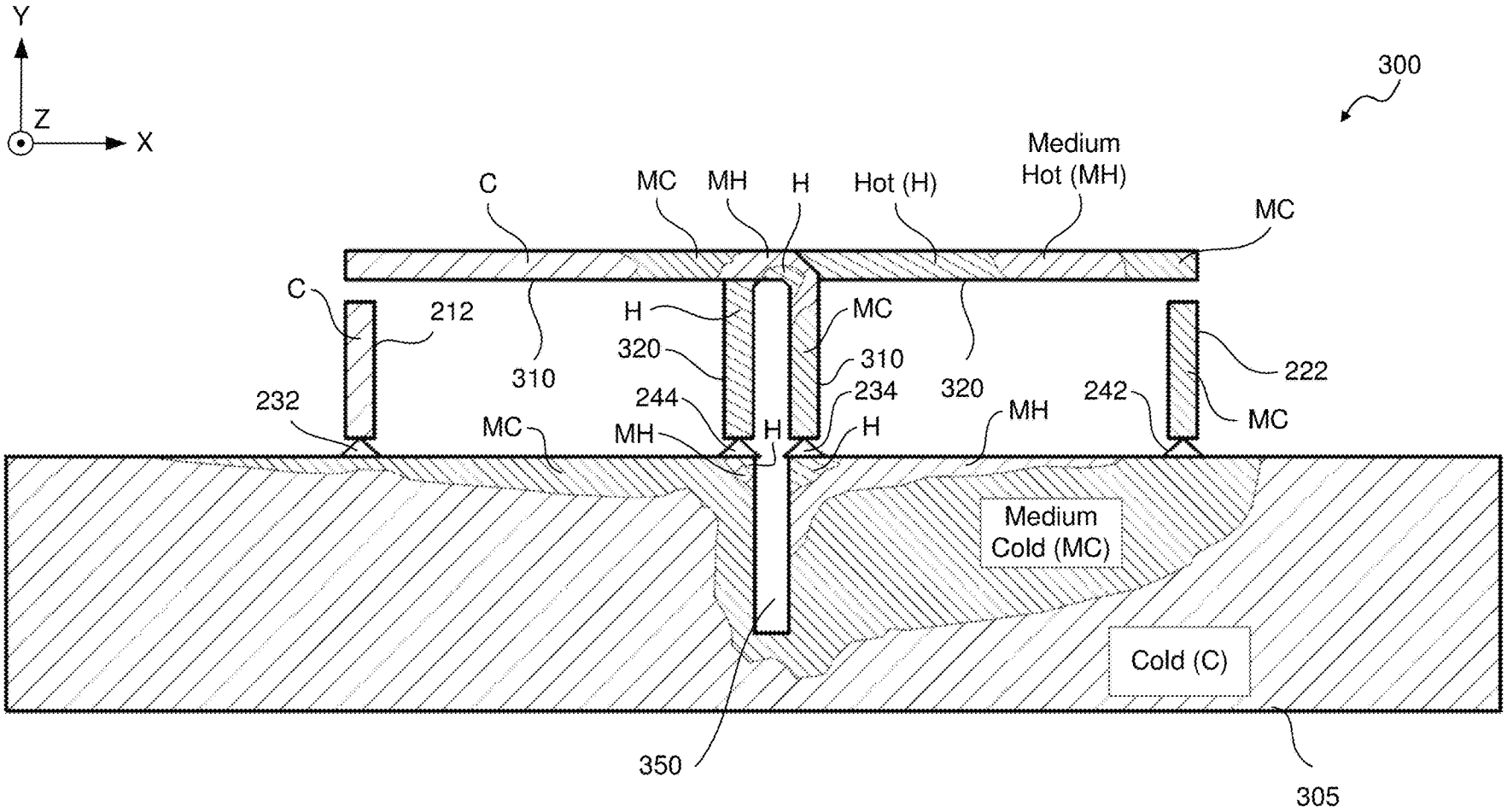
FIG. 3B illustrates a surface current of the antenna system of FIG. 3A.

In an exemplary aspect, the antenna element 310 and the antenna element 320 are positioned in an overlapping configuration such that the antenna elements 310 and 320 have a current balanced and/or impedance matched relationship. In this example, an increased (e.g., high) impedance point (e.g. virtual high impedance point) is formed at the overlapping segments of the antenna elements 310 and 320 (e.g., at and/or in the proximity of the overlapping area/location 360). This high impedance point is illustrated in FIG. 3B showing the surface current of the antenna system 300 represented as a thermal image. In the thermal image, lower surface currents are represented by lower temperatures while higher surface currents are represented by higher temperatures. The temperatures from coldest to hottest include cold (C), medium-cold (MC), medium-hot (MH), and hot (H). In this example, the second coupler 222 is feed by an RF signal via feed 242, which couples to the second antenna element 320. The surface current in antenna element 320 increases as represented by the medium-hot and hot temperature areas along the antenna element 320. With the high impedance point (e.g. virtual high impedance point) formed at the overlapping segments of the antenna elements 310 and 320 (e.g., at and/or in the proximity of the overlapping area/location 360), the coupling from the second antenna element 320 to the first antenna element 310 is reduced. The reduced coupling is illustrated by the lower surface currents in the first antenna element 310, which is represented by the colder temperatures along the antenna element 310.

Figure 6:
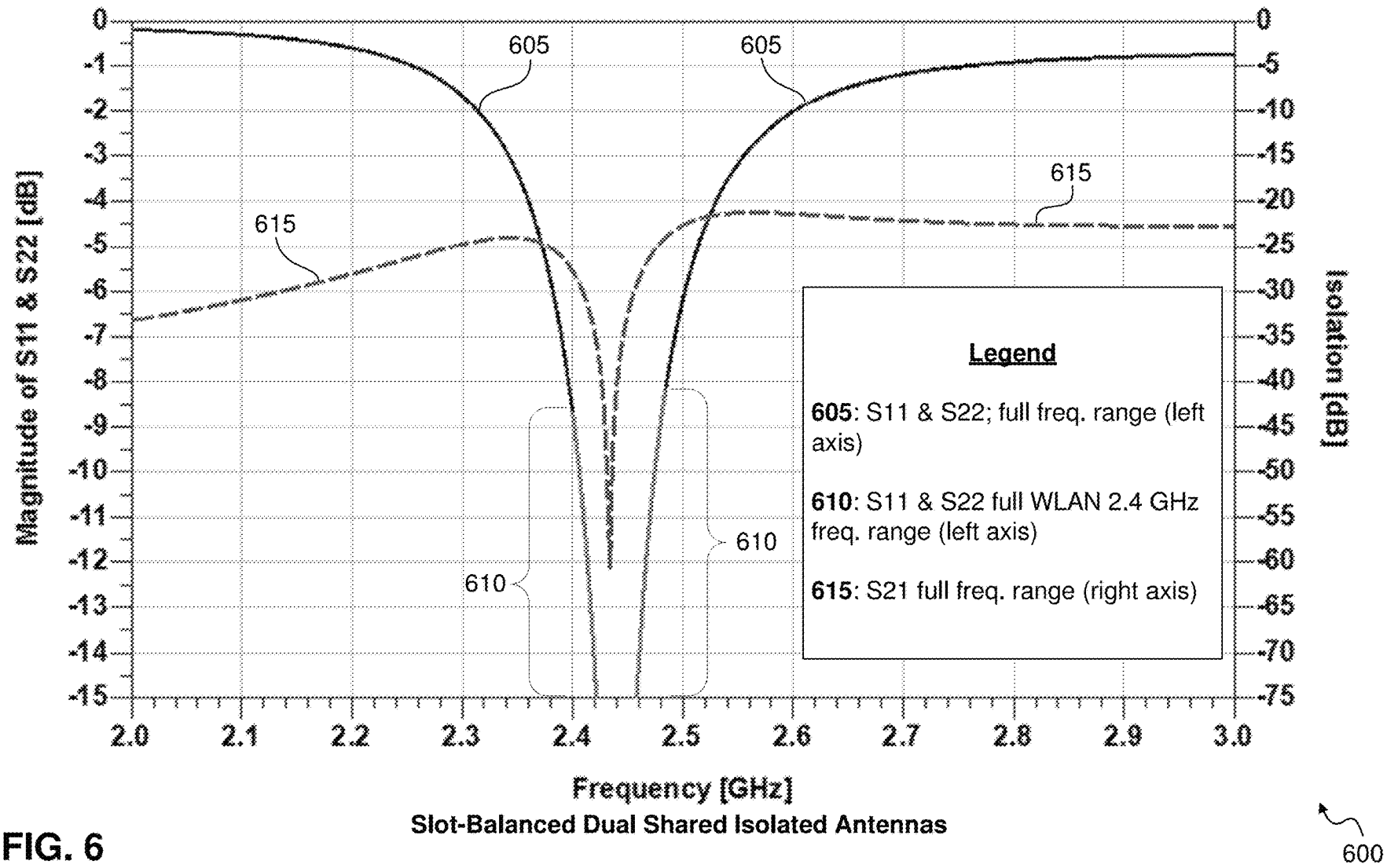
FIG. 6 illustrates an example S-parameter plot for the antenna system of FIG. 3A according to an exemplary aspect of the present disclosure.

Returning to FIG. 3A, in an exemplary aspect, the support plane 305 includes the slot 350, which can have a width D8 and length D9. In an exemplary aspect, the dimensions of the slot 350 can be adjusted to place the antenna elements 310, 320 in a current balanced and/or impedance matched relationship. Advantageously, because the slot 350 is separate from the antenna structures of the antenna elements 310, 320, the antenna system 300 is more easily tuned into the current balanced and/or impedance matched relationship. That is, by implementing the tuning feature (e.g., the slot 350) on the support plane 305, which is closer to the ground potential, the tuning of the antenna elements 310, 320 in a current balanced and/or impedance matched relationship is more easily facilitated. The impedance bandwidth and isolation is further illustrated by the plot 600 of the S-parameters in FIG. 6.

In an exemplary aspect, one or more dimensions (e.g., length D9) can be adjusted based on the arrangement and/or dimensions of the antenna elements 310 and/or 320 to place the antenna elements 310, 320 in a current balanced and/or impedance matched relationship. In an exemplary aspect, the length D9 and/or width D8 can be adjusted so that an electrical length of the slot 350 places the antenna elements 310, 320 in a current balanced and/or impedance matched relationship, thereby forming a high impedance point at the overlapping segments of the antenna elements 310 and 320 (e.g., at and/or in the proximity of the overlapping area/location 360). In an exemplary aspect, the width D8 can be, for example, 1 mm, and the length D9 can be, for example, 5 mm, but is not limited thereto. As illustrated in FIG. 3A, the slot 350 is rectangular, but is not limited thereto and can be differently shaped.

In an exemplary aspect, the antenna arrangement of the antenna system 300 may include two single WLAN antennas (antenna elements). The two antennas may be mirrored versions of each other, placed on each side of the PCB and share part of the same volume. The isolation between the two antenna elements (for e.g. 2.4 GHz WLAN) can be increased without the addition of one or more discrete circuit components 140, such as one or more resistors and/or one or more reactive components (e.g., inductor, capacitor), as in an aspect of the antenna systems 100 and/or 101 by configuring the antenna elements 310, 320 in a current balanced and/or impedance matched relationship. The balanced/matched relationship creates a choke (e.g. high impedance point) between the two antenna elements 310, 320 so that, for example, the RF signal fed to the first coupler 222 does not "see" the capacitive region of the second antenna element 310 to reduce the coupling to the second coupler 212 (first RF feed), and vice versa. This choking characteristic is illustrated in FIG. 3B and the S-parameter plot of FIG. 6, which shows that a sufficient (high) isolation between the antenna elements 310, 320 is realized by the current balanced and/or impedance matched relationship of the antenna system 300.

Figure 4:
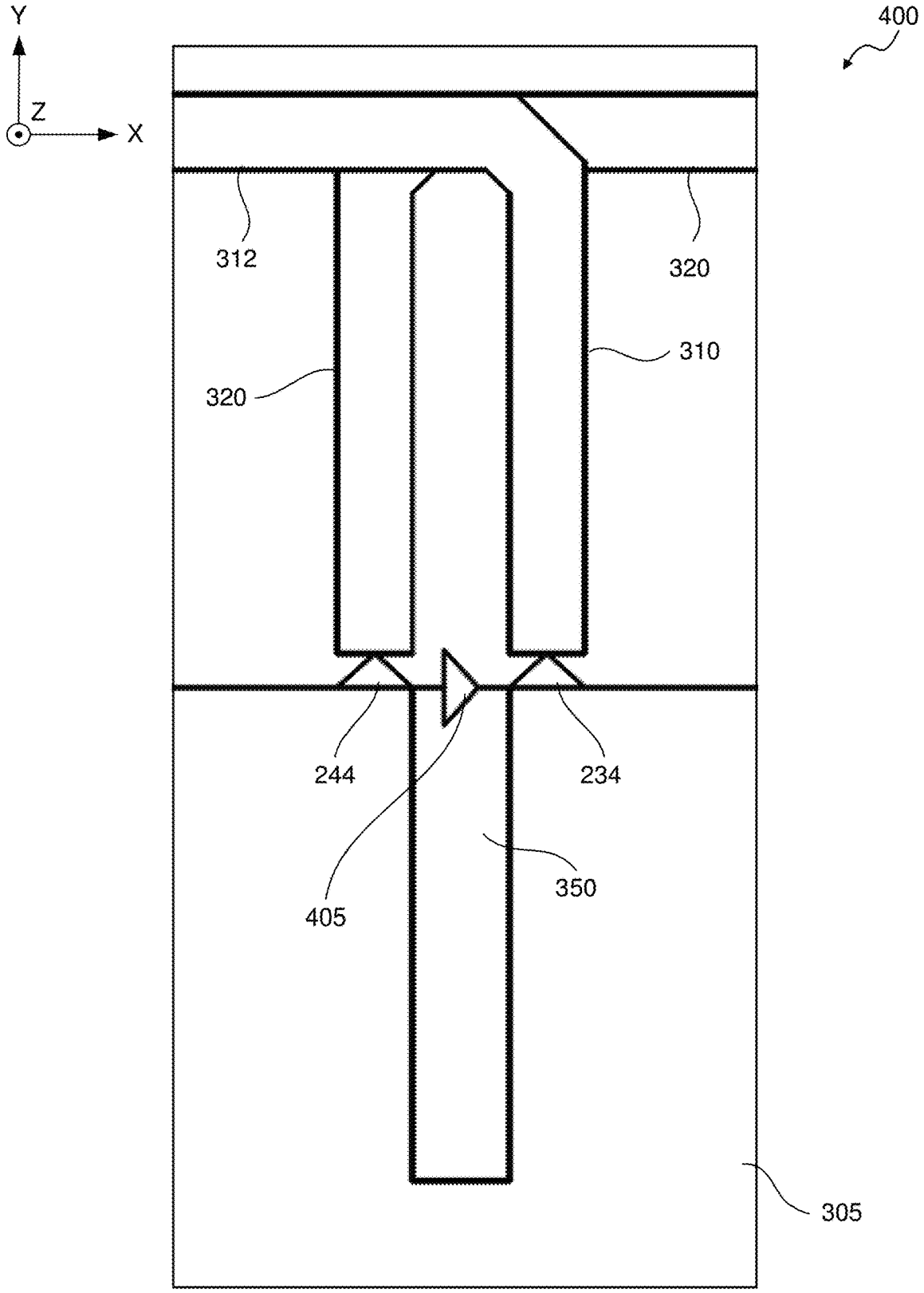
FIG. 4 illustrates a top view of an antenna system having a tuning component across a slot of a support plane according to an exemplary aspect of the present disclosure.

FIG. 4 illustrates an antenna system 400 according to an exemplary aspect of the present disclosure. The antenna system 400 is an exemplary aspect of the antenna system 300, which includes a tuning component (tuner) 405 connected across the slot 350. The drawing of FIG. 4 shows an enlarged portion of the antenna system 400 to focus on the slot 350 and the tuning component 405. The remaining portions of the antenna elements 310, 320 and corresponding couplers 212, 222 are not shown, but are similarly configured as shown in FIG. 3A.

In an exemplary aspect, the tuning component 405 is coupled across the slot 350. In an exemplary aspect, the tuning component 405 includes one or more discrete circuit components, such as one or more resistors and/or one or more reactive components (e.g., capacitors and/or inductors). In an exemplary aspect, the tuning component 405 is a tunable or fixed capacitor, but is not limited thereto. The resistive, capacitive, and/or inductive value of the tuning component 405 can be adjusted based on one or more dimensions of the slot 350. In an exemplary aspect, the resistive, capacitive, and/or inductive value of the tuning component 405 can be adjusted to place the antenna elements 310, 320 in the current balanced and/or impedance matched relationship (e.g., tuned to the choke frequency) at a desired frequency (changing the frequency of the choke resonance). In an exemplary aspect, the connections 234, 244 can include one or more discrete circuit components. The respective resonances of the antenna elements 310, 320 can be tuned by adjusting: (1) the resistive, inductive, and/or capacitive values of one or more discrete circuit components included in the connections 234, 244 and that couple the antenna elements 310, 320 to the ground plane of the support plane 305; and/or (2) the resistive, inductive, and/or capacitive values of the couplers 212, 222.

Figure 7:
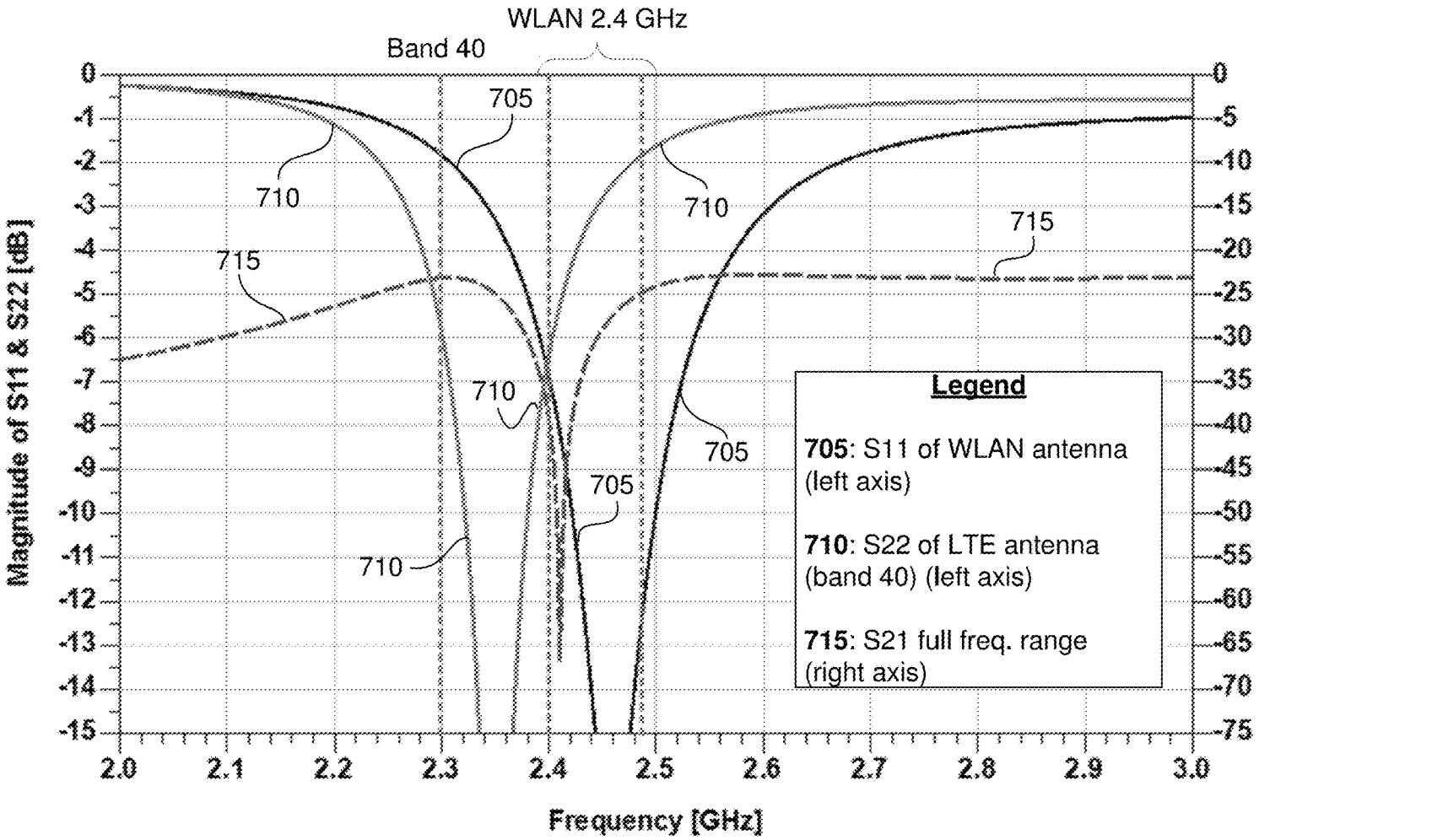
FIGS. 7-9B illustrate example S-parameter plots for an antenna system according to exemplary aspects of the present disclosure.
Figure 8:
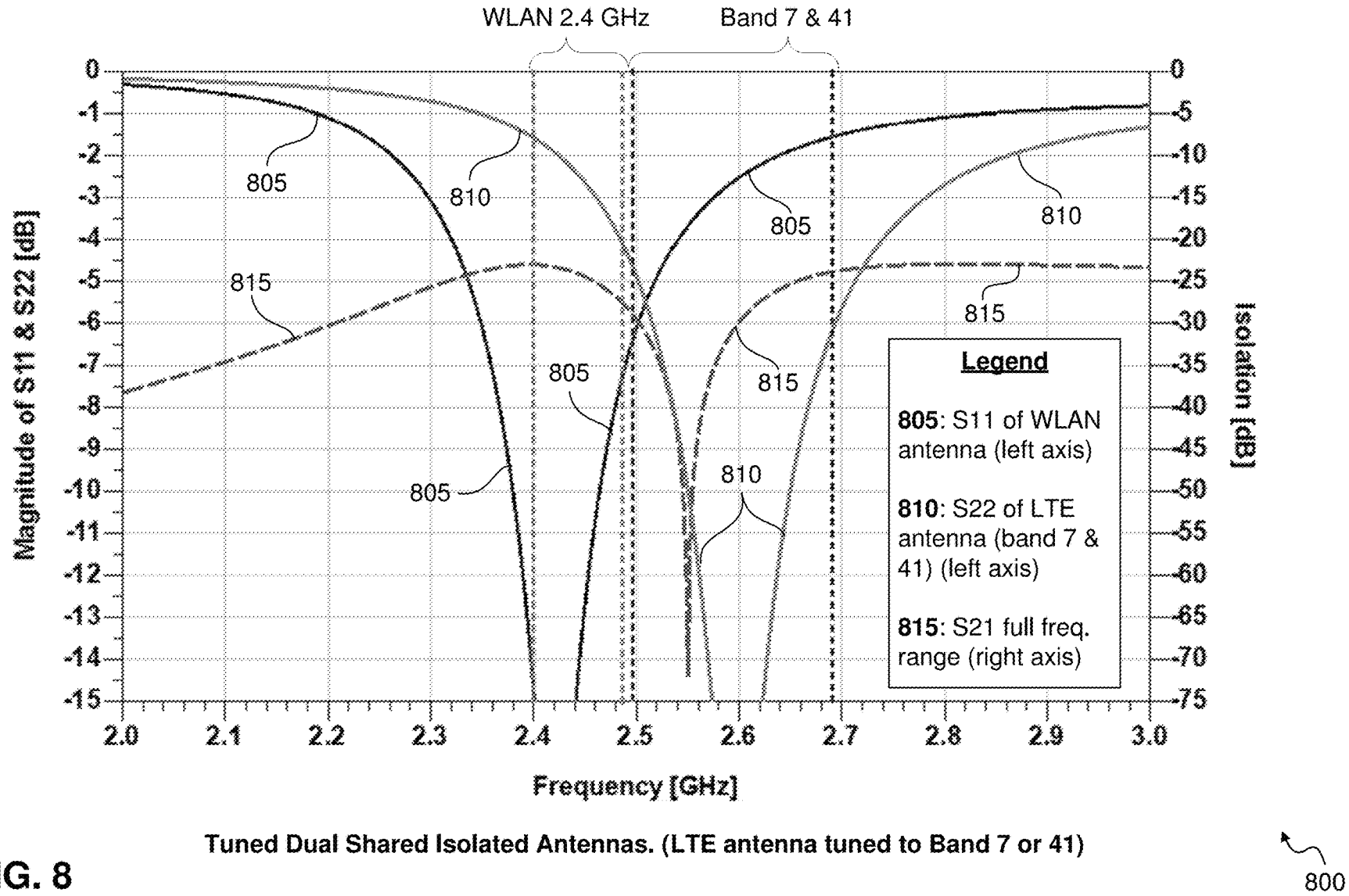

In an exemplary aspect, the antenna system 400 (and/or one or more of the systems 100-300) can be configured for other (e.g., wider) frequency ranges, including one or more Long-Term Evolution (LTE) frequencies. In an exemplary aspect, antenna element 310 can be configured for one or more WLAN frequencies or frequency bands, and antenna element 320 can be configured for one or more LTE frequencies or frequency bands. For example, antenna element 310 can be configured for (but not limited to) 2.4 GHz WLAN and antenna element 320 can be configured for (but not limited to) LTE Band 40, or Bands 7 & 41. FIG. 7 and FIG. 8 illustrate the impedance bandwidth and isolation of the antenna system 400 of the S-parameters for Band 40 (plot 700) and Bands 7 & 41 (plot 800), respectively.

In an exemplary aspect, the capacitive value of the tuning component 405 and the inductive values of one or more of the connections 234, 244 can be adjusted to place the antenna elements 310, 320 in the current balanced and/or impedance matched relationship. Example values are shown in Table 1 for Band 40 (FIG. 7) and Bands 7 & 41 (FIG. 8), but the present disclosure is not limited to these values.

TABLE 1

Example capacitive/inductive values

| Tuning Stage | Resonance Inductor | Balance Capacitor |
|---|---|---|
| Band 40 | 2 nH | 6 pF |
| Band 7 & 41 | 0 nH | 12 pF |

Figure 9A:
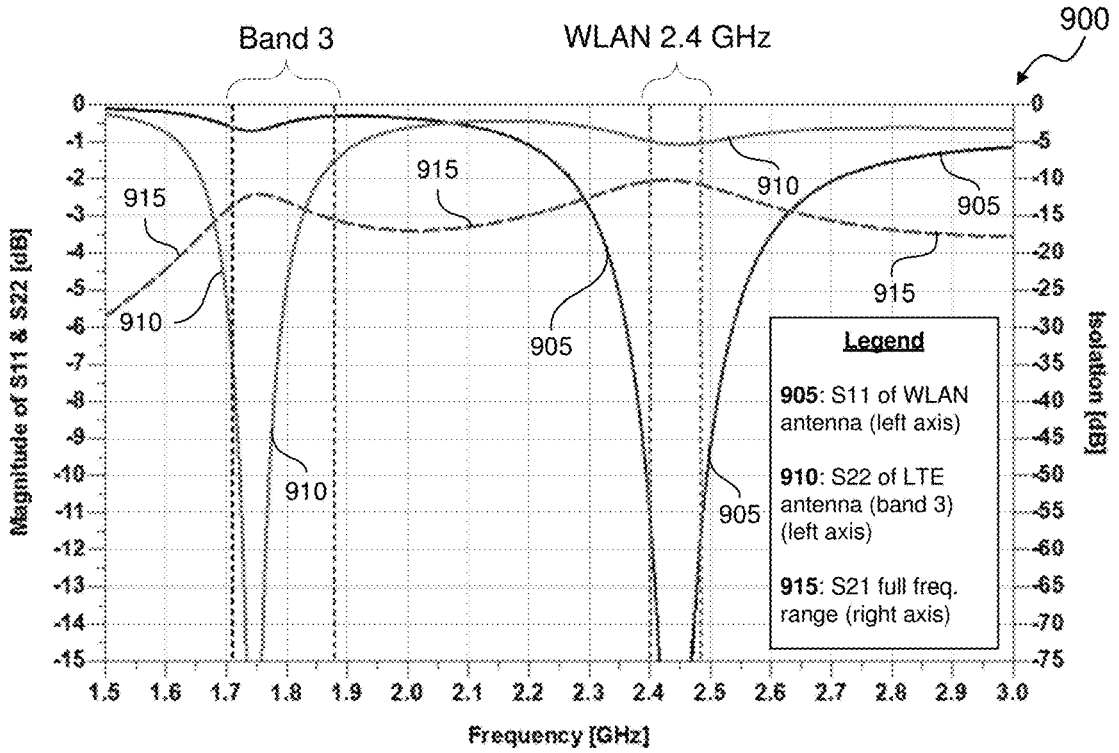
Figure 9B:
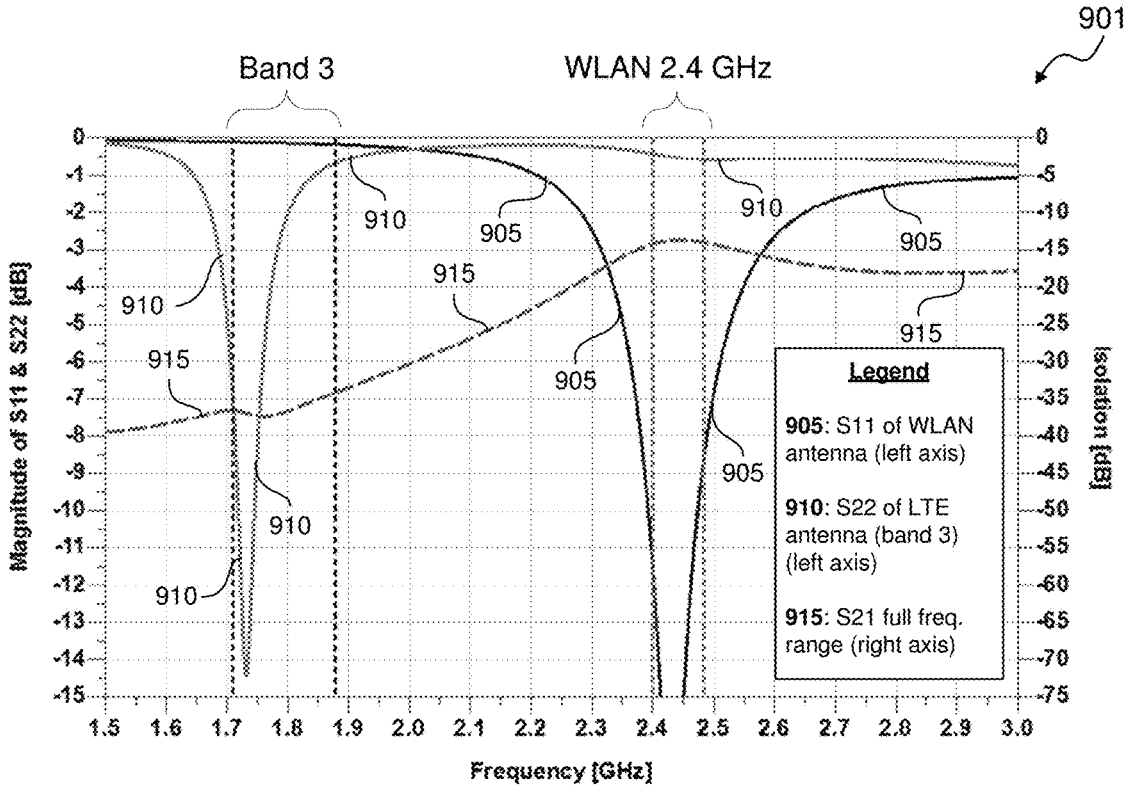

The present disclosure can also extend to resonances that are father apart, for example (but not limited to), LTE Band 3 and WLAN. FIG. 9A illustrates the impedance bandwidth and isolation of the S-parameters for Band 3 and WLAN in an unbalanced system. FIG. 9B illustrates the increased impedance bandwidth and isolation of the S-parameters for Band 3 and WLAN in a balanced system, such as antenna system 400 that includes the tuning component 405.

Figure 10:
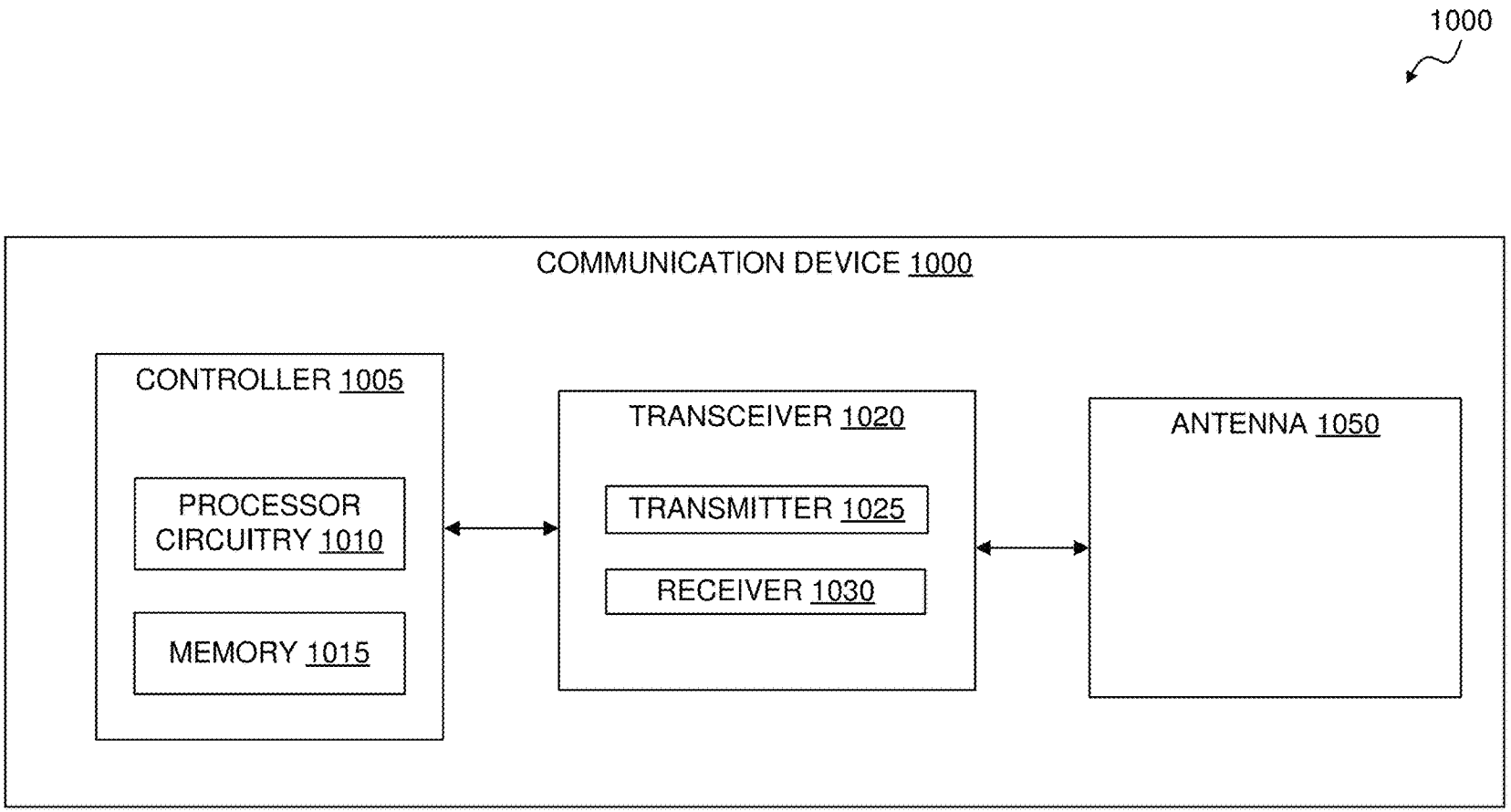
FIG. 10 illustrates an example of a communications device including an antenna system according to an exemplary aspect of the present disclosure.

An example of an implementation using an antenna system according to one or more exemplary aspects is illustrated in FIG. 10. FIG. 10 schematically illustrates an example of a communications device, such as a mobile phone or user equipment 1000. The communication device 1000 can include an antenna system 1050 according to one or more exemplary aspects described herein. A transceiver 1020 may be coupled to the antenna system 1050. A controller 1005 can be configured to control the transceiver 1020 to transmit and/or receive wireless communications via the antenna system 1050. To this end, communications devices may be provided having reduced bezel size and improved design.

The controller 1005 can include processor circuitry 1010 that is configured to carry out instructions to perform arithmetical, logical, and/or input/output (I/O) operations of the communication device 1000, and/or one or more components of the communication device 100, such as the transceiver 1020. The processor circuitry 1010 can be configured to control the operation of the transceiver 1020—including, for example, transmitting and/or receiving of wireless communications via the transceiver 1020, and/or perform one or more baseband processing functions (e.g., media access control (MAC), encoding/decoding, modulation/demodulation, data symbol mapping, error correction, etc.). The controller 1005 can include one or more digital signal processers (DSPs), one or more modulators and/or demodulators, one or more digital-to-analog converters (DAC) and/or an analog-to-digital converters (ADC), and/or one or more frequency converters (including mixers, local oscillators, and filters) to provide some examples.

The controller 1005 can further include a memory 1015 that stores data and/or instructions, where when the instructions are executed by the processor circuitry 1010, controls the processor circuitry 1010 to perform the functions described herein. The memory 1015 can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory 1015 can be non-removable, removable, or a combination of both.

The transceiver 1020 can be configured to transmit and/or receive wireless communications via one or more wireless technologies. The transceiver 1020 can include one or more circuits configured to transmit and/or receive wireless communications. For example, the transceiver 1020 can include one or more transmitters 1025 and one or more receivers 1030 that are configured to transmit and receive wireless communications, respectively, via the antenna system 1050.

EXAMPLES

Example 1 is an antenna arrangement, comprising: a support plane; a first antenna element coupled to the support plane; and a second antenna element coupled to the support plane and positioned in a current balance relationship with the first antenna.

In Example 2, the subject matter of Example 1, further comprising: a first coupler configured to capacitively couple to the first antenna element; and a second coupler configured to capacitively couple to the second antenna element.

In Example 3, the subject matter of Example 2, wherein the first and second couplers are configured to create a matched impedance at respective feeds of the first and the second antenna elements.

In Example 4, the subject matter of Example 1, wherein an increased impedance point is created at an intersection of the first antenna element and the second antenna element based on the position of the second antenna element with respect to the first antenna element.

In Example 5, the subject matter of Example 1, wherein the first antenna element is connected to a ground plane of the support plane adjacent to a connection of the second antenna element to the ground plane.

In Example 6, the subject matter of Example 5, wherein the adjacent connections of the first antenna element and the second antenna element to the ground plane creates the current balanced relationship between the first and the second antenna elements.

In Example 7, the subject matter of Example 7, wherein: a first end of the first antenna element is coupled to the first coupler and a second end of the first antenna opposite the first end of the first antenna element is connected to a ground plane at a first ground plane connection; a first end of the second antenna element is coupled to the second coupler and a second end of the second antenna opposite the first end of the second antenna element is connected to the ground plane at a second ground plane connection; and the first ground plane connection and the second ground plane connection are adjacent to each other to create the current balanced relationship between the first and the second antenna elements.

In Example 8, the subject matter of Example 1, wherein the first and the second antenna elements at least partially overlap when viewed in a direction perpendicular to the support plane, and wherein an increased impedance point is created in an area where the first antenna element overlaps and the second antenna element.

In Example 9, the subject matter of Example 1, wherein: the first antenna element is configured to radiate an electromagnetic wave according to a first transmission standard, and the second antenna element is configured to radiate an electromagnetic wave according to a different second transmission standard.

In Example 10, the subject matter of Example 9, wherein: the first transmission standard is a transmission standard for a wireless local area network; and the second transmission standard is a transmission standard for a cellular network.

Example 11 is a mobile communications device comprising an antenna arrangement according to any of claims 1-10.

Example 12 is an antenna arrangement, comprising: a support plane having a slot; a first antenna element coupled to the support plane and extending across the slot; and a second antenna element coupled to the support plane and extending across the slot, wherein the slot is configured to create a current balanced relationship between the first and the second antenna elements.

In Example 13, the subject matter of Example 12, wherein a dimension of the slot is configured based on respective dimensions of the first and the second antenna elements.

In Example 14, the subject matter of Example 12, wherein a characteristic of the slot is configured to create the current balanced relationship between the first and the second antenna elements.

In Example 15, the subject matter of Example 12, wherein an electrical length of the slot is configured to create the balanced relationship between the first and the second antenna elements.

In Example 16, the subject matter of Example 12, wherein the first antenna element is connected to a ground plane of the support plane on a first side of the slot and the second antenna element is connected to the ground plane of the support plane on second side of the slot and spaced apart from the connection of the first antenna element to the ground plane by a width of the slot.

In Example 17, the subject matter of Example 12, further comprising: a first coupler configured to indirectly couple to the first antenna element; and a second coupler configured to indirectly couple to the second antenna element, wherein: a first end of the first antenna element is coupled to the first coupler and a second end of the first antenna opposite the first end of the first antenna element is connected to a ground plane at a first ground plane connection on a first side of the slot; and a first end of the second antenna element is coupled to the second coupler and a second end of the second antenna opposite the first end of the second antenna element is connected to the ground plane at a second ground plane connection on a second side of the slot and spaced apart from the connection of the first antenna element to the ground plane by a width of the slot to create the current balanced relationship between the first and the second antenna elements.

In Example 18, the subject matter of Example 17, wherein the first coupler is configured to capacitively or inductively couple to the first antenna element and the second coupler is configured to capacitively or inductively couple to the second antenna element.

Example 19 is an antenna arrangement, comprising: a support plane having a slot; a first antenna element coupled to a ground plane of the support plane by a first electrical component; a second antenna element coupled to the ground plane of the support plane by a second electrical component, wherein the slot is positioned between the coupling of the first antenna element to the ground plane and the coupling of the second antenna element to the ground plane; and a third electrical component coupled across a width of the slot and configured to tune a current balance between the first and the second antenna elements and a frequency of the current balance.

In Example 20, the subject matter of Example 19, wherein the first and the second electrical components are configured to adjust respective resonance frequencies of the first and the second antenna elements.

In Example 21, the subject matter of Example 19, wherein the first electrical component, the second electrical component, and the third electrical components are reactive components.

In Example 22, the subject matter of Example 19, wherein the third electrical component is a capacitor.

In Example 23, the subject matter of Example 19, wherein the first and second electrical components are inductors.

In Example 24, the subject matter of Example 19, wherein an electrical characteristic of the third electrical component is configured based on one or more dimensions of the slot.

In Example 25, the subject matter of Example 1, wherein the first antenna element and the second antenna element are arranged on a same surface of the support plane.

In Example 26, the subject matter of Example 1, wherein the first antenna element is arranged on a first surface of the support plane, and wherein the second antenna element is arranged on a second surface of the support plane, the second surface being opposite to the first surface.

In Example 27, the subject matter of Example 1, wherein the first antenna element is arranged on a surface of the support plane, and wherein the second antenna element is arranged on an intermediate layer of the support plane.

In Example 28, the subject matter of Example 1, wherein the first antenna element is arranged on a first intermediate layer of the support plane, and wherein the second antenna element is arranged on a second intermediate layer of the support plane.

In Example 29, the subject matter of Example 1, wherein the first antenna element and the second antenna element are both configured to resonate at a same resonance frequency.

In Example 31, the subject matter of Example 2, wherein the first coupler and the second coupler are configured to resonate at a same resonance frequency.

In Example 32, the subject matter of any of Examples 1-3, wherein an increased impedance point is created at an intersection of the first antenna element and the second antenna element based on the position of the second antenna element with respect to the first antenna element.

In Example 33, the subject matter of any of Examples 1-3, wherein the first antenna element is connected to a ground plane of the support plane adjacent to a connection of the second antenna element to the ground plane.

In Example 34, the subject matter of Example 33, wherein the adjacent connections of the first antenna element and the second antenna element to the ground plane creates the current balanced relationship between the first and the second antenna elements.

Example 35 is an apparatus substantially as shown and described.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. For example, a circuit can include an analog circuit, a digital circuit, state machine logic, other structural electronic hardware, or a combination thereof. A processor can include a microprocessor, a digital signal processor (DSP), or other hardware processor. The processor can be "hard-coded" with instructions to perform corresponding function(s) according to aspects described herein. Alternatively, the processor can access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, processor circuitry can include memory that stores data and/or instructions. The memory can be any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

A communication device can include (but is not limited to): a mobile device—such as a laptop computer, a tablet computer, a mobile telephone or smartphone, a "phablet," a personal digital assistant (PDA), and mobile media player; and a wearable computing device—such as a computerized wrist watch or "smart" watch, and computerized eyeglasses, Internet of Things (IoT) devices—such as a smart home/building devices (e.g., sensors, cameras, lighting, switches, outlets, voice-capable assistants, thermostats, appliances, etc.); robotics; and drones.

One or more of the exemplary aspects described herein can be implemented using one or more wireless communications conforming to one or more communication standards/protocols, including (but not limited to), Long-Term Evolution (LTE), Evolved High-Speed Packet Access (HSPA+), Wideband Code Division Multiple Access (W-CDMA), CDMA2000, Time Division-Synchronous Code Division Multiple Access (TD-SCDMA), Global System for Mobile Communications (GSM), General Packet Radio Service (GPRS), Enhanced Data Rates for GSM Evolution (EDGE), and/or Worldwide Interoperability for Microwave Access (WiMAX) (IEEE 802.16), to one or more non-cellular communication standards, including (but not limited to) WLAN (IEEE 802.11), Bluetooth, Near-field Communication (NFC) (ISO/IEC 18092), ZigBee (IEEE 802.15.4), Radio-frequency identification (RFID), and/or to one or more well-known navigational system protocols, including the Global Navigation Satellite System (GNSS), the Russian Global Navigation Satellite System (GLONASS), the European Union Galileo positioning system (GALILEO), the Japanese Quasi-Zenith Satellite System (QZSS), the Chinese BeiDou navigation system, and/or the Indian Regional Navigational Satellite System (IRNSS) to provide some examples. These various standards and/or protocols are each incorporated herein by reference in their entirety.

What is claimed is:

1. An antenna arrangement, comprising:

a support plane;

a first antenna element coupled to the support plane via a first connection, the first antenna element terminating at a distal end that is opposite to the first connection of the first antenna element to the support plane;

a second antenna element coupled to the support plane via a second connection, the second antenna element (i) terminating at a distal end that is opposite to the second connection of the second antenna element to the support plane, and (ii) positioned in a current balanced relationship with the first antenna element;

a first coupler that is galvanically shielded from the first antenna element and disposed substantially perpendicular and proximate to the distal end of the first antenna element, the first coupler being configured to couple to the first antenna element via the distal end of the first antenna element; and a second coupler that is galvanically shielded from the second antenna element and disposed substantially perpendicular and proximate to the distal end of the second antenna element, the second coupler being configured to couple to the second antenna element via the distal end of the second antenna element.

2. The antenna arrangement of claim 1, wherein the first and second couplers are configured to create a matched impedance at respective feeds of the first and the second antenna elements.

3. The antenna arrangement of claim 1, wherein an increased impedance point is created at an intersection of the first antenna element and the second antenna element based on the position of the second antenna element with respect to the first antenna element.

4. The antenna arrangement of claim 1, wherein the first antenna element is connected to a ground plane of the support plane adjacent to a connection of the second antenna element to the ground plane.

5. The antenna arrangement of claim 4, wherein the adjacent connections of the first antenna element and the second antenna element to the ground plane creates the current balanced relationship between the first and the second antenna elements.

6. The antenna arrangement of claim 4, wherein the first antenna element and the second antenna element cross one another at a crossing region that is proximate to the first connection of the first antenna element to the ground plane and the second connection of the second antenna element to the ground plane.

7. The antenna arrangement of claim 6, wherein the first antenna element and the second antenna element cross one another at opposite sides of the support plane, and wherein the first antenna element is coupled to the second antenna element via a reactive component at the crossing region.

8. The antenna arrangement of claim 1, wherein the first and the second antenna elements at least partially overlap when viewed in a direction perpendicular to the support plane, and wherein an increased impedance point is created in an area where the first antenna element overlaps with the second antenna element.

9. The antenna arrangement of claim 1, wherein:

the first antenna element is configured to radiate an electromagnetic wave according to a first transmission standard, and the second antenna element is configured to radiate an electromagnetic wave according to a second, different transmission standard.

10. The antenna arrangement of claim 9, wherein:

the first transmission standard is a transmission standard for a wireless local area network; and the second transmission standard is a transmission standard for a cellular network.

11. A mobile communications device comprising an antenna arrangement according to claim 1.

12. The antenna arrangement of claim 1, wherein:

the first antenna element extends in first direction that is perpendicular to the first coupler and the second coupler, the second antenna element extends in a second direction that is perpendicular to the first coupler and the second coupler, the first direction and the second direction are opposite directions, and the first antenna element and the second antenna element overlap with one another at a crossing region that is parallel to the first direction and the second direction.

13. An antenna arrangement, comprising:

a support plane having a slot;

a first antenna element coupled to the support plane via a first connection and extending across the slot, the first antenna element terminating at a distal end that is opposite to the first connection of the first antenna element to the support plane;

a second antenna element coupled to the support plane via a second connection and extending across the slot, the second antenna element terminating at a distal end that is opposite to the second connection of the second antenna element to the support plane;

a first coupler galvanically shielded from the first antenna element and disposed substantially perpendicular and proximate to the distal end of the first antenna element, the first coupler being configured to couple to the first antenna element via the distal end of the first antenna element; and a second coupler galvanically shielded from the second antenna element and disposed substantially perpendicular and proximate to the distal end of the second antenna element, the second coupler being configured to couple to the second antenna element via the distal end of the second antenna element, wherein the slot is configured to create a current balanced relationship between the first and the second antenna elements.

14. The antenna arrangement of claim 13, wherein a dimension of the slot is configured based on respective dimensions of the first and the second antenna elements.

15. The antenna arrangement of claim 13, wherein a characteristic of the slot is configured to create the current balanced relationship between the first and the second antenna elements.

16. The antenna arrangement of claim 13, wherein an electrical length of the slot is configured to create the balanced relationship between the first and the second antenna elements.

17. The antenna arrangement of claim 13, wherein:

the first antenna element is connected to a ground plane of the support plane on a first side of the slot, the second antenna element is connected to the ground plane of the support plane on a second side of the slot, and the connection of the second antenna element is spaced apart from the connection of the first antenna element by a width of the slot.

18. The antenna arrangement of claim 13, wherein:

the first antenna element is connected to a ground plane via the first connection on a first side of the slot; and the second antenna element is connected to the ground plane via the second connection on a second side of the slot and spaced apart from the connection of the first antenna element to the ground plane by a width of the slot to create the current balanced relationship between the first and the second antenna elements.

19. The antenna arrangement of claim 18, wherein the first coupler is configured to capacitively or inductively couple to the first antenna element, and wherein the second coupler is configured to capacitively or inductively couple to the second antenna element.

20. The antenna arrangement of claim 13, wherein the first antenna element extends across the slot in a direction towards the second connection of the second antenna element to the support plane, and wherein the second antenna element extends across the slot in a direction towards the first connection of the first antenna element to the support plane.

21. An antenna arrangement, comprising:

a support plane having a slot formed by removing material from the support plane having a width and length dimension;

a first antenna element coupled to a ground plane of the support plane at a first end by a first electrical component, the first antenna element terminating at a second end that is distal from the first end associated with the first electrical component;

a second antenna element coupled to the ground plane of the support plane at a first end by a second electrical component, the second antenna element terminating at a second end that is distal from the first end associated with the second electrical component, wherein the slot is positioned between the coupling of the first antenna element to the ground plane and the coupling of the second antenna element to the ground plane;

a first coupler that is galvanically shielded from the first antenna element and disposed substantially perpendicular and proximate to the second end of the first antenna element;

a second coupler that is galvanically shielded from the second antenna element and disposed substantially perpendicular and proximate to the second end of the second antenna element; and a third electrical component coupled across the width dimension of the slot and configured to tune a current balance between the first and the second antenna elements.

22. The antenna arrangement of claim 21, wherein the first and the second electrical components are configured to adjust respective resonance frequencies of the first and the second antenna elements.

23. The antenna arrangement of claim 21, wherein the first electrical component, the second electrical component, and the third electrical components are reactive components.

24. The antenna arrangement of claim 21, wherein the third electrical component is a capacitor.

25. The antenna arrangement of claim 21, wherein the first and second electrical components are inductors.

26. The antenna arrangement of claim 21, wherein an electrical characteristic of the third electrical component is configured based on one or more dimensions of the slot.

27. The antenna arrangement of claim 21, wherein the first antenna element and the second antenna element overlap with one another at a crossing region that substantially aligns with a center of the slot formed in the support plane.

* * * * *